US010919659B2

(12) United States Patent
Arnold et al.

(10) Patent No.: US 10,919,659 B2
(45) Date of Patent: Feb. 16, 2021

(54) SYSTEMS AND METHODS FOR PACKAGING FOOD PRODUCTS IN CONTAINERS AND CONTAINERS PACKAGED BY SUCH SYSTEMS AND METHODS

(71) Applicant: Bellisio Foods, Inc., Jackson, OH (US)

(72) Inventors: Robert W. H. Arnold, Jackson, OH (US); Ryan Wright, Jackson, OH (US); Lacy Andrew Miller, Wellston, OH (US)

(73) Assignee: BELLISIO FOODS, INC., Jackson, OH (US)

( * ) Notice: Subject to any disclaimer, the term of this patent is extended or adjusted under 35 U.S.C. 154(b) by 0 days.

(21) Appl. No.: 16/183,349

(22) Filed: Nov. 7, 2018

(65) Prior Publication Data

US 2020/0140132 A1 May 7, 2020

(51) Int. Cl.
*B65B 51/22* (2006.01)
*B65B 7/28* (2006.01)
(Continued)

(52) U.S. Cl.
CPC ..... *B65B 51/225* (2013.01); *B65B 5/068* (2013.01); *B65B 7/2842* (2013.01); *B65B 43/42* (2013.01); *B65D 5/246* (2013.01); *B65D 5/64* (2013.01)

(58) Field of Classification Search
CPC .. B65B 5/04; B65B 5/246; B65B 7/28; B65B 7/2842; B65B 7/2878; B65B 51/22; B65B 51/225
USPC ..... 53/471, 477, 478, 282, 284.5, 329.2, 53/329.3, 329.4; 156/73.1, 580.1, 580.2; 229/186–189, 125.35
See application file for complete search history.

(56) References Cited

U.S. PATENT DOCUMENTS 4,495,749 A 1/1985 Faller et al.
4,964,562 A 10/1990 Gordon et al.
(Continued)

FOREIGN PATENT DOCUMENTS

AU 198285133 A 1/1983
CN 203268578 U 11/2013
(Continued)

OTHER PUBLICATIONS

International Search Report and Written Opinion for PCT/US2019/038883, dated Aug. 30, 2019, 11 pages.

*Primary Examiner* — Christopher R Demeree
*Assistant Examiner* — Phillip D Schmidt
(74) *Attorney, Agent, or Firm* — Armstrong Teasdale LLP

(57) ABSTRACT

A system for packaging a food product in a container generally includes a conveyance apparatus operable to move trays in a machine direction, a delivery apparatus operable to deposit the food product into cavities of the trays, and a positioning apparatus operable to position covers relative to the trays. The positioning apparatus is configured to position each cover on a respective tray to overlap a flange of the respective tray. The system also comprises an ultrasonic bonding apparatus configured to receive the flange and the cover of each container in the nip between a first bonding module and a second bonding module. At least one of the first bonding module and the second bonding module vibrates at an ultrasonic frequency and delivers ultrasonic energy to at least one of the cover and the flange to seal the container.

14 Claims, 19 Drawing Sheets

(51) Int. Cl.

| | |
|---|---|
| ***B65D 5/24*** | (2006.01) |
| ***B65B 43/42*** | (2006.01) |
| ***B65B 5/06*** | (2006.01) |
| ***B65D 5/64*** | (2006.01) |

(56) References Cited

U.S. PATENT DOCUMENTS

| | | | | |
|---|---|---|---|---|
| 5,096,052 | A * | 3/1992 | Raque | B29C 65/08 198/803.15 |
| 5,176,314 | A * | 1/1993 | Akazawa | B29C 65/08 229/125.35 |
| 5,244,145 | A * | 9/1993 | Forbes, Jr. | B65D 5/246 206/459.5 |
| 5,345,747 | A * | 9/1994 | Raque | B29C 65/081 53/373.7 |
| 5,393,360 | A | 2/1995 | Bridges et al. | |
| 6,050,055 | A * | 4/2000 | Calvert | B29C 65/18 53/300 |
| 7,216,504 | B2 | 5/2007 | Armer et al. | |
| 9,242,754 | B2 | 1/2016 | Masuda et al. | |
| 2004/0164134 | A1 | 8/2004 | Gong et al. | |
| 2010/0024360 | A1 | 2/2010 | Ehrmann et al. | |
| 2013/0059708 | A1* | 3/2013 | White | B29C 66/83511 493/186 |
| 2015/0175298 | A1* | 6/2015 | McMahon | B65D 5/3621 229/182 |
| 2018/0093444 | A1* | 4/2018 | Begrow | B32B 7/04 |
| 2019/0084710 | A1* | 3/2019 | Wolf | B65B 51/26 |

FOREIGN PATENT DOCUMENTS

| | | | | |
|---|---|---|---|---|
| CN | 204673146 | U | 9/2015 | |
| CN | 206459999 | U | 9/2017 | |
| CN | 206523473 | U | 9/2017 | |
| EP | 962398 | B1 | 4/2003 | |
| GB | 2540843 | A | 2/2017 | |
| GB | 2548787 | A | 10/2017 | |
| JP | 57004727 | A | 1/1982 | |
| JP | 3000671 | A | 1/1991 | |
| JP | 3200560 | A | 9/1991 | |
| JP | 3200562 | A | 9/1991 | |
| JP | 3240667 | A | 10/1991 | |
| JP | 3289440 | A | 12/1991 | |
| JP | 4031203 | A | 2/1992 | |
| JP | 4044911 | A | 2/1992 | |
| JP | 4327155 | A | 11/1992 | |
| JP | 5310268 | A | 11/1993 | |
| JP | 5310270 | A | 11/1993 | |
| JP | 10241783 | A | 9/1998 | |
| JP | 2000033927 | A | 2/2000 | |
| JP | 2000043915 | A | 2/2000 | |
| JP | 2000309356 | A | 11/2000 | |
| JP | 2000318046 | A | 11/2000 | |
| JP | 2002028993 | A | 1/2002 | |
| JP | 2003112762 | A | 4/2003 | |
| JP | 2004051101 | A | 2/2004 | |
| JP | 2004126182 | A | 4/2004 | |
| JP | 2004315017 | A | 11/2004 | |
| JP | 2010029066 | A | 2/2010 | |
| JP | 2014184981 | A | 10/2014 | |
| JP | 2016153130 | A | 8/2016 | |
| KR | 918823 | B1 | 9/2009 | |
| KR | 1268157 | B1 | 5/2013 | |
| WO | 2004040293 | A1 | 5/2004 | |
| WO | WO-2008091774 | A1 * | 7/2008 | B65D 5/563 |
| WO | 2014080053 | A1 | 5/2014 | |

* cited by examiner

SYSTEMS AND METHODS FOR PACKAGING FOOD PRODUCTS IN CONTAINERS AND CONTAINERS PACKAGED BY SUCH SYSTEMS AND METHODS

BACKGROUND

The present disclosure relates generally to food containers and, more particularly, to systems and methods for packaging food products in containers and sealing the containers using ultrasonic bonding, and containers packaged by such systems and methods.

Typical containers for storing food products include an outer wall defining an interior space to store the food products. The containers may be designed for a single use and be disposed or recycled after use. For example, the containers may be constructed from plastic or paperboard materials. The containers may be sealed to protect the food product within the interior space from the surrounding environment and to prevent food products from spilling out of the interior space. The containers may be sealed using fastening mechanisms and/or adhesive. However, it may be difficult to seal the containers completely and effectively using the fastener mechanisms and adhesive.

Some containers for packaging food products may include two or more portions that enclose the food products. For example, the food product may be positioned within a cavity of a tray and a cover may be attached to the tray. However, the cover may contact the tray only along a peripheral edge of the tray and it may be difficult to seal the containers completely along the peripheral edge of the tray. Accordingly, some trays include a flange for the cover to rest on and be attached to. However, the food product may fall onto the flange when the food product is positioned in the cavity and the food product may prevent a complete seal between the cover and the tray.

Sometimes the container is sealed by heating at least a portion of the container (e.g., the flange of the tray and the portion of the cover engaging the flange) to a bonding temperature using microwaves. However, the microwave process requires large amounts of electricity relative to other steps in the packaging process and the electrical service requirements for packaging the food product may need to be increased to accommodate the microwave process. In addition, shielding must be included in the systems to protect people from the microwaves. Also, cooling systems may be required downstream of the microwave system to allow further handling and processing of the container because the container is heated to a relatively high temperature in the microwave system to form the seal. Moreover, the microwave system is unable to properly seal the container if food product is present on the flange of the tray and/or the cover. Further, the entire system may need to be shut down for regular maintenance or repair of the microwave components. The microwave system is also vulnerable to fouling and jamming, which results in the line being shut down until the fouling or jamming is cleared.

Therefore, there is a need for improved systems and methods for packaging food product in containers.

SUMMARY

In one embodiment, a system for packaging a food product in a container generally comprises a conveyance apparatus operable to move trays in a machine direction. Each tray defines a cavity and includes at least one wall and a flange extending from an edge of the wall. The system further comprises a delivery apparatus operable to deposit the food product into the cavities of the trays and a positioning apparatus operable to position covers relative to the trays. The positioning apparatus is configured to position each cover on a respective tray to overlap the flange of the respective tray. The cover and the tray cooperatively form the container. The system also comprises an ultrasonic bonding apparatus comprising a first bonding module and a second bonding module. The second bonding module is positionable in close proximity to the first bonding module to define a nip therebetween. The ultrasonic bonding apparatus is configured to receive the flange and the cover of each container in the nip between the first bonding module and the second bonding module. At least one of the first bonding module and the second bonding module vibrates at an ultrasonic frequency and delivers ultrasonic energy to at least one of the cover and the flange to seal the container. The nip has a thickness less than 0.030 in.

In another embodiment, a method for packaging a food product in a container generally comprises moving a tray in a machine direction. The tray includes at least one wall defining a cavity and a flange extending from an edge of the wall. The method also comprises depositing the food product into the cavity and positioning a cover relative to the tray. The cover is positioned to overlap the flange of the tray. The cover and the tray form the container. The method further comprises positioning a first bonding module in close proximity to a second bonding module. At least one of the first bonding module and the second bonding module vibrates at an ultrasonic frequency. The method also comprises positioning the flange and the cover between the first bonding module and the second bonding module and delivering ultrasonic energy to at least one of the cover and the flange to form an ultrasonic bond on the container. The ultrasonic bond extends continuously in the machine direction along the entirety of the cover and the flange.

In yet another embodiment, a container for a food product generally comprises a tray and a cover. The tray includes a bottom having a perimeter and a sidewall extending along the perimeter of the bottom to form a cavity sized to receive the food product. The sidewall defines an opening for the food product to be placed into the cavity. The sidewall includes a pair of first portions defining longitudinal sides of the container and a pair of second portions defining transverse sides of the container. The sidewall also includes an edge extending along the first portions and the second portions. The tray further includes a flange extending from the edge of the sidewall and around the opening. The cover is attached to the flange of the tray by ultrasonic bonds. The ultrasonic bonds extend along the longitudinal and transverse sides of the container.

BRIEF DESCRIPTION OF THE DRAWINGS

Corresponding reference characters indicate corresponding parts throughout the several views of the drawings.

DETAILED DESCRIPTION

Figure 1:
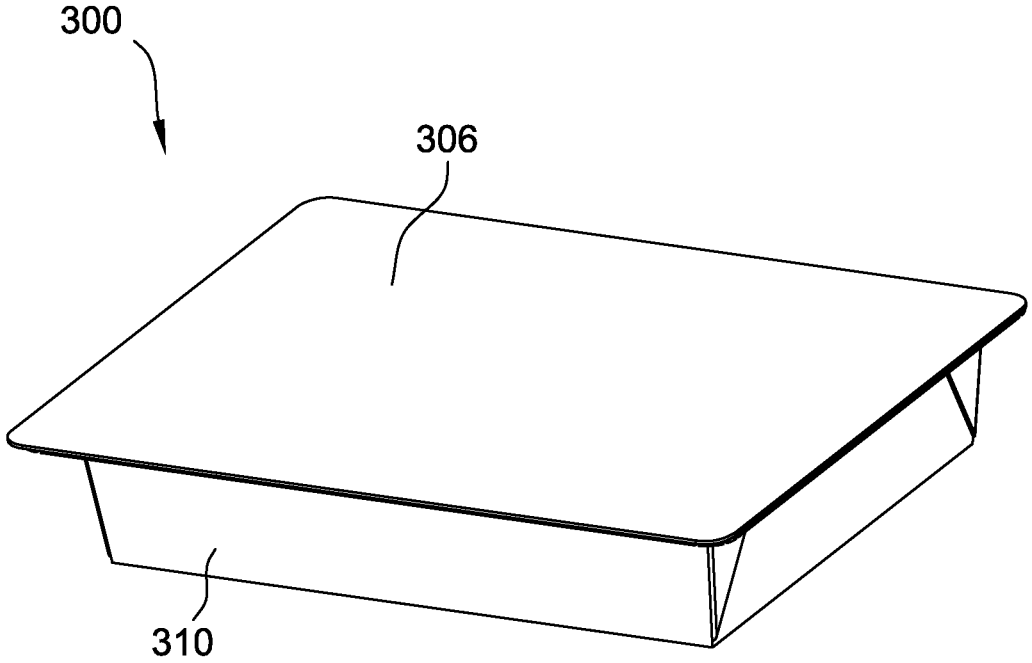
FIG. 1 is a perspective view of one suitable embodiment of a container of the present disclosure.
Figure 2:
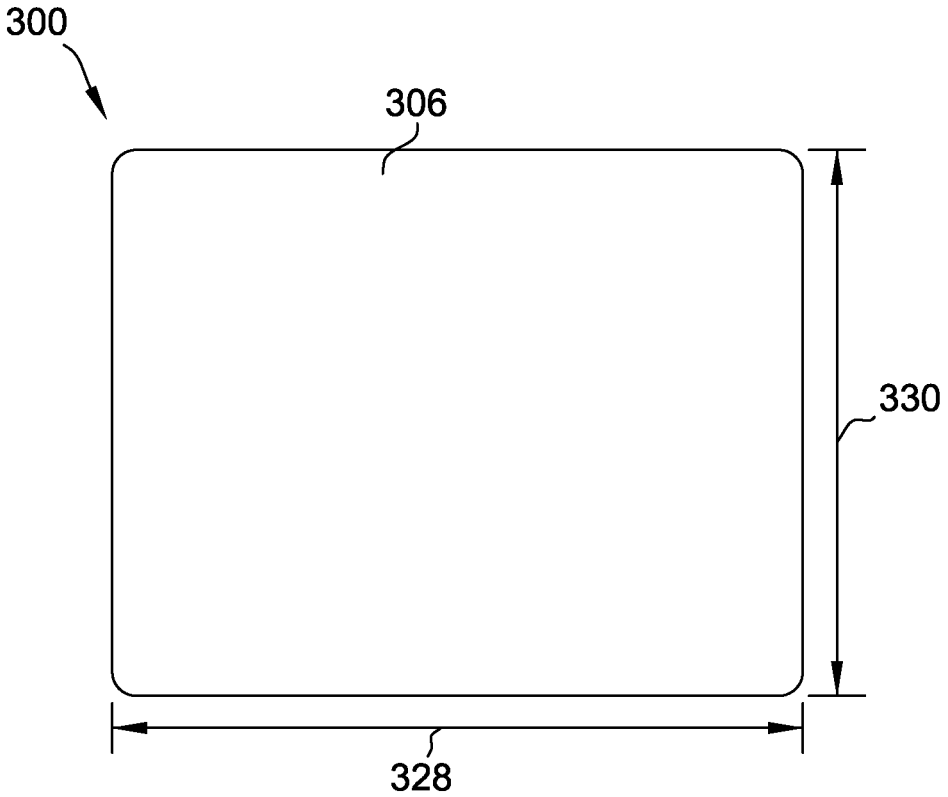
FIG. 2 is a top view of the container of FIG. 1.

Referring now to the drawings and in particular to FIGS. 1-5, a container for containing a food product having one suitable embodiment of the present disclosure is generally indicated at 300. The container 300 includes an end wall (or bottom wall) 302, a sidewall 304, and a cover 306. Together the sidewall 304 and the end wall 302 form a tray (indicated generally at 310) and define a cavity 308 arranged to receive a food product therein. The sidewall 304 defines an open end 312 of the tray 310 and allows placement of food within the cavity 308. The cover 306 is arranged to attach to the tray 310 and close the open end 312. The container 300 may be sealed to prevent food within the cavity 308 from spilling out of the container and to prevent materials on the exterior of the container 300 from contacting the food within the cavity 308. Specifically, in the illustrated embodiment, the cover 306 and tray 310 are ultrasonically bonded to hermetically seal the container 300.

In the illustrated embodiment, the sidewall 304 extends along a perimeter of the end wall 302 and between the end wall 302 and the cover 306. The sidewall 304 includes four planar portions 318, 320 that define four sides of the container. Specifically, first portions 318 of the sidewall 304 define longitudinal sides of the container 300 and second portions 320 of the sidewall 304 define transverse sides (or ends) of the container. The portions 318, 320 of the sidewall 304 of the illustrated embodiment of the container 300 are slightly angled relative to the end wall 302 and the cover 306. However, it is understood that the portions 318, 320 of the sidewall 304 of the container 300 can be generally perpendicular to the end wall 302 and the cover 306. In addition, the first portions 318 are generally aligned with the second portions 320 about the same angle relative to the end wall 302 and the cover 306. The first portions 318 are connected to the second portions 320 at vertical edges. In other suitable embodiments, the sidewall 304 may have different configurations without departing from some aspects of the disclosure.

The cover 306, the end wall 302, and the sidewall 304 collectively define the cavity 308. In the illustrated embodiment, the end wall 302 and the cover 306 are planar and generally rectangular. A length 322 (FIG. 5) of the cavity 308 is defined between the second portions 320 of the sidewall 304. A width 324 of the cavity 308 is defined between the first portions 318 of the sidewall 304. In the illustrated embodiment, the length 322 is greater than the width 324. For example, the length 322 may be in a range of about 5 inch (in.) to about 11 in. or about 6 in. to about 10 in. or about 7 in. to about 9 in., and the width 324 may be in a range of about 3.5 in. to about 7.5 in. or about 4 in. to about 7 in. or about 4.5 in. to about 6.5 in. In the illustrated embodiment, the length 322 is about 6 in. and the width is about 4.5 in. Accordingly, the cavity 308 has a generally rectangular cuboid shape. The cavity 308 may have other shapes (e.g., square) without departing from some aspects of the disclosure.

Figure 3:
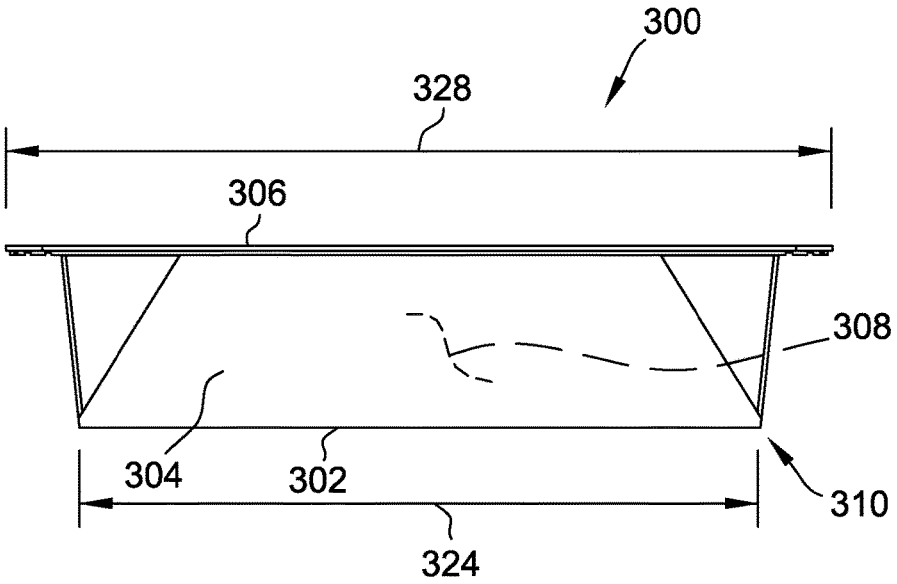
FIG. 3 is a first side view of the container.
Figure 4:
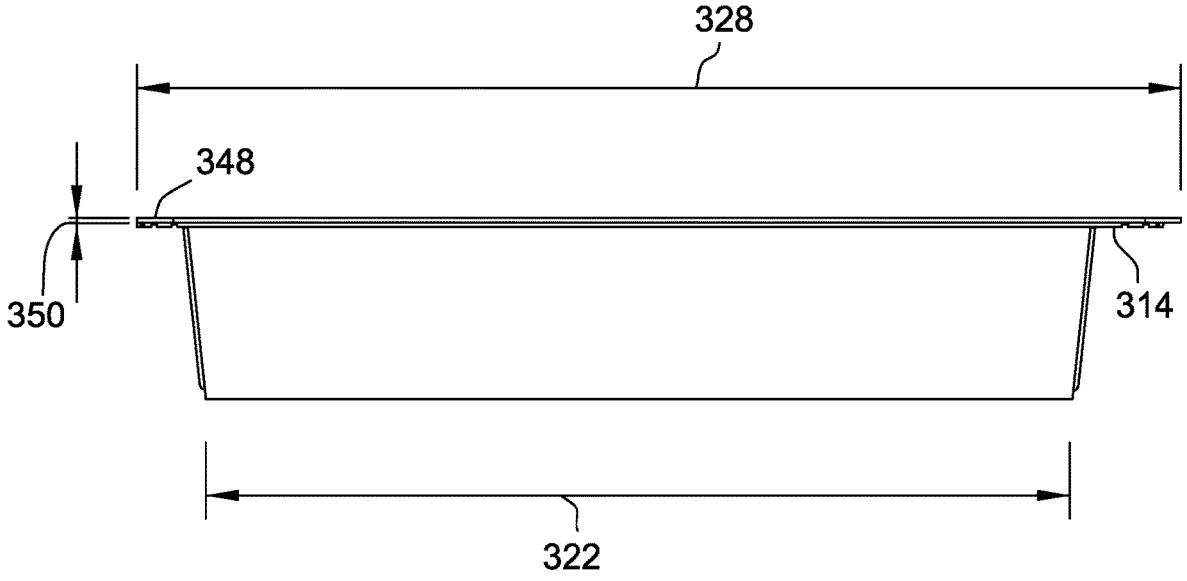
FIG. 4 is a second side view of the container.
Figure 5:
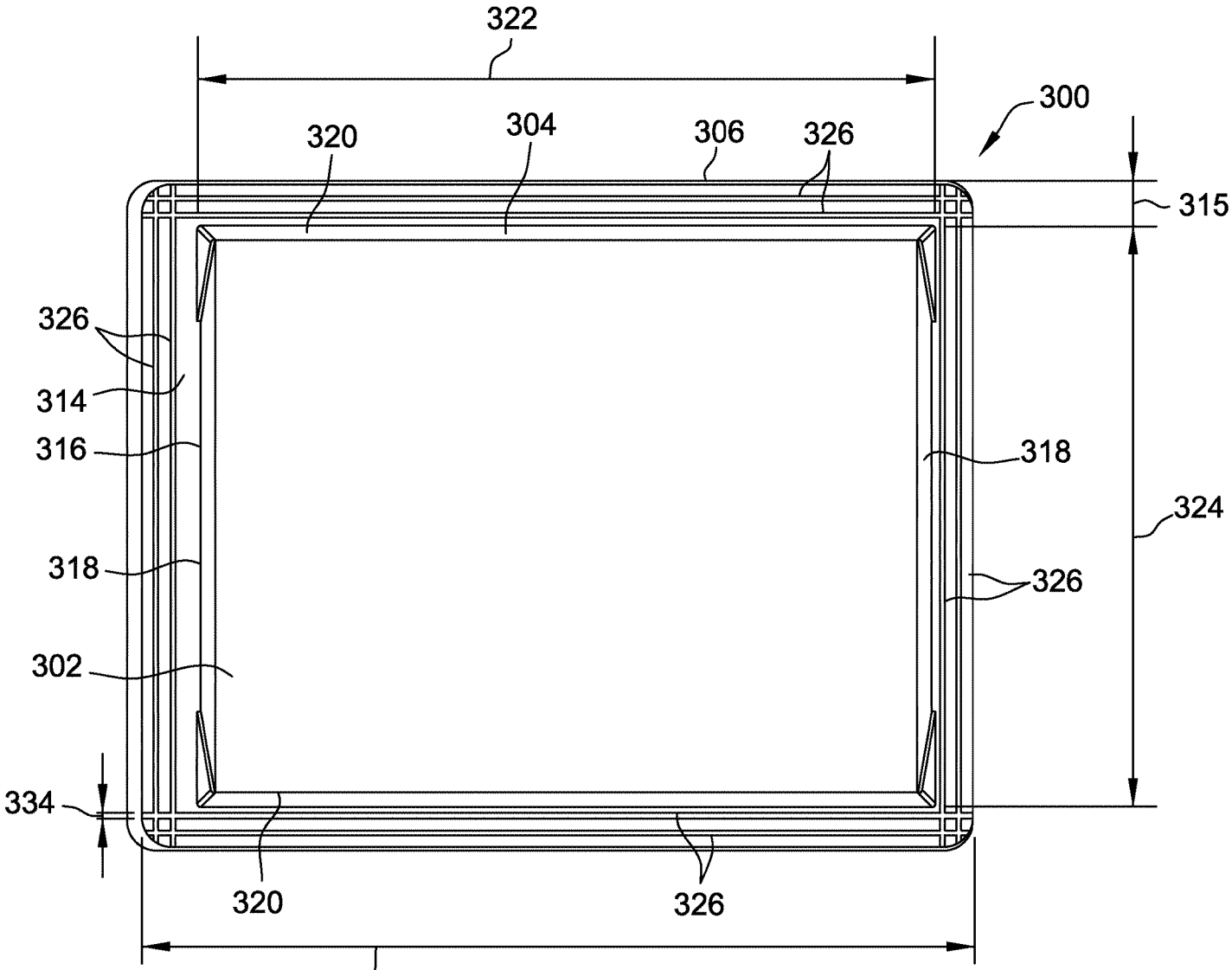
FIG. 5 is a bottom view of the container.
Figure 7:
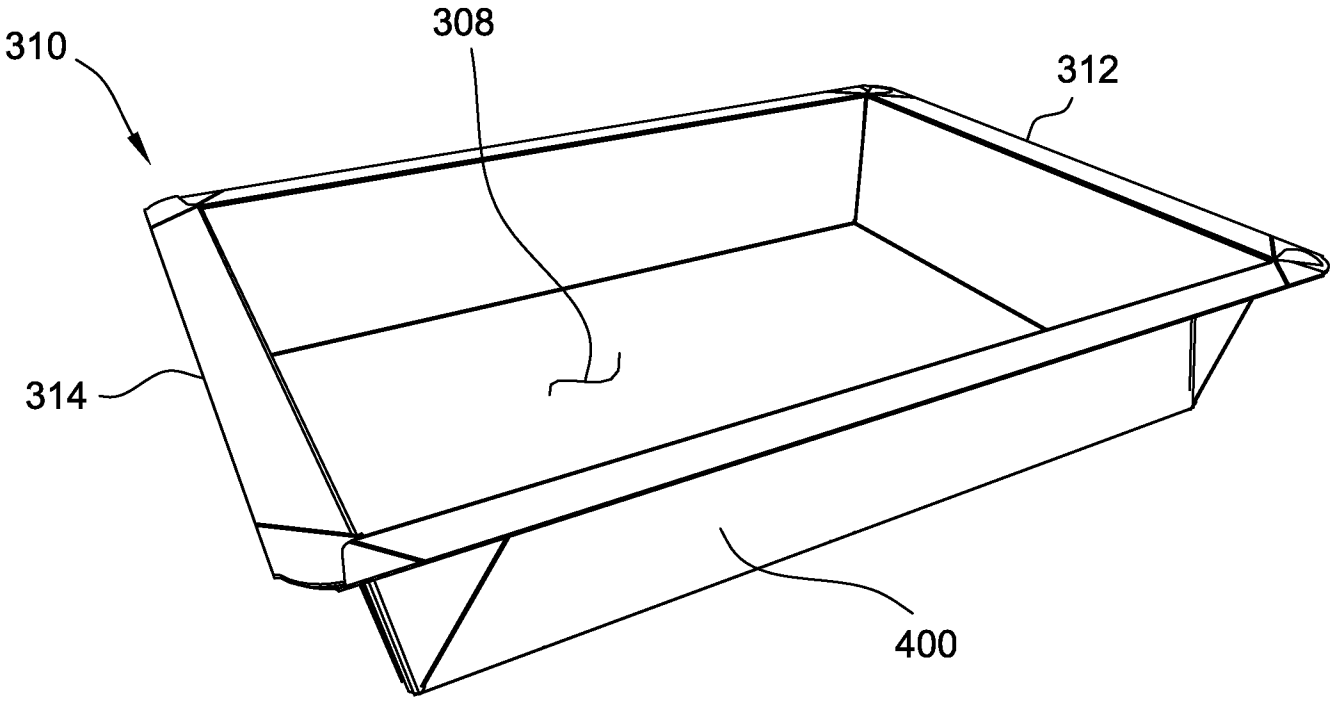
FIG. 7 is a perspective view of the paperboard blank in a folded configuration to form the tray of the container.

As best illustrated in FIG. 7, a flange 314 extends continuously along an edge 316 of the sidewall 304 opposite the end wall 302. The flange 314 supports the cover 306, as seen in FIG. 3-5, and provides sufficient surface area for the tray 310 to be bonded to the cover 306. For example, a total surface area of the flange may be in range of about 4.75 $in^2$ to about 29.25 $in^2$ or about 9.75 $in^2$ to about 14.6 $in^2$. The flange 314 extends outward from the sidewall 304 in a direction away from the cavity 308 and generally parallel to the end wall 302.

The flange 314 has a width 315 that is defined between a proximal edge connected to the edge 316 of the sidewall 304 and a distal edge spaced from the sidewall 304. The flange 314 may have the width 315 that is in a range of about 0.25 in. to about 0.75 in. or about 0.375 in. to about 0.5 in. In the illustrated embodiment, the width 315 is approximately 0.375 in.

The flange 314 has a thickness that is defined between opposite surfaces of the flange 314. For example, in some areas, the flange 314 may include a single layer and have a thickness in a range of about 0.015 in. to about 0.02 in. or about 0.016 in. to about 0.018 in. In other areas, the flange 314 includes two layers and may have a thickness in a range of about 0.03 in. to about 0.04 in. or about 0.032 in. to about 0.036 in. In other suitable embodiments, the flange 314 may be other sizes without departing from some aspects of the disclosure.

In the illustrated embodiment, the cover 306 is larger than the end wall 302 and is sized to extend beyond the sidewall 304 and contact the flange 314 when the cover 306 is positioned onto the tray 310. Specifically, the length 328 of the cover 306 is greater than the length 322 of the cavity 308 and the width 330 of the cover 306 is greater than the width 324 of the cavity 308. For example, the cover 306 may have a width 330 in a range of about 4.75 in. to about 8.75 in. or about 5 in. to about 8 in. or about 5.75 in. to about 7.75 in. and a length 328 of about 6.25 in. to about 12.25 in. or about 6.5 in. to about 12 in. or about 5 in. to about 10 in. In the illustrated embodiment, the cover 306 has a length 328 of about 7.19 in. and a width 330 of about 5.69 in.

The cover 306 includes an upper surface 346 and a lower surface 348. The upper surface 346 may rest on an upper surface of the flange 314 when the container 300 is assembled. The cover 306 may have a thickness 350 defined between the upper surface 346 and the lower surface 348. For example, the cover 306 may have a thickness in a range of about 0.015 in. to about 0.02 in. or about 0.016 in. to about 0.018 in. In other suitable embodiments, the container 300 can have any suitable size and/or shape without departing from some aspects of this disclosure.

As seen in FIG. 5, the cover 306 is attached to the flange 314 of the tray 310 by ultrasonic bonds 326. The ultrasonic bonds 326 extend along the entirety of both the longitudinal sides and the transverse sides of the container 300 and form a continuous, hermetic seal between the cover 306 and the tray 310. In the illustrated embodiment, a pair of spaced-apart, parallel ultrasonic bonds 326 extends along each of the longitudinal sides and the transverse sides. In addition and as seen in FIG. 5, the ultrasonic bonds 326 overlap in the corners of the flange 314 to provide the continuous seal. Specifically, first and second pairs of ultrasonic bonds 326 extend along the longitudinal sides of the container 300 and overlap third and fourth pairs of ultrasonic bonds extending along the transverse sides of the container. In some suitable embodiments, any number of ultrasonic bonds, including one, may extend along one or more side of the container 300. The ultrasonic bonds 326 extend along the entirety of each side of the container 300 to provide a complete seal of the container and to allow for overlapping in the corners. The ultrasonic bonds 326 allow the container 300 to be hermetically sealed without the use of microwaves or other conventional means that require relatively large amounts of energy and require the container 300 to be heated to a relatively high temperature.

Each ultrasonic bond 326 has a length 332 and a width 334. The length 332 of each of the ultrasonic bonds 326 is greater than the corresponding sidewall portion 318, 320 to allow the ultrasonic bonds 326 to overlap in the corners of the flange 314. In addition, the widths 334 are less than the width 315 of the flange 314. For example, the width 334 of each bond may be in a range of about 0.074 in. to about 0.5 in. or about 0.125 in. to about 0.4 in. The ultrasonic bonds 326 on a respective side may be spaced apart from each other and define a space therebetween that has width less than about 0.140 in. or in a range of about 0.02 in. to about 0.120 in. In the illustrated embodiment, the ultrasonic bonds 326 on the transverse sides are identical to each other and the ultrasonic bonds 326 on the longitudinal sides are identical to each other. In other suitable embodiments, one or more of the ultrasonic bonds 326 may be different from the other ultrasonic bonds 326.

In the illustrated embodiment, the ultrasonic bonds 326 do not extend across the entire width of the flange 314 and a portion of the flange 314 and the cover 306 may be unbonded, i.e., free from ultrasonic bonds, in some areas. For example, a ratio of the widths 334 of the ultrasonic bonds 326 to the width 315 of the flange 314 may be in a range of about 0.074 to about 0.5. The unbonded portions may be located between the ultrasonic bonds 326 and on opposite sides of the ultrasonic bonds 326. For example, a ratio of the width 334 of the ultrasonic bonds 326 to the width of the space between the ultrasonic bonds 326 may be in a range of about 0.5 to about 1. The unbonded space between the ultrasonic bonds 326 allows the ultrasonic bonds 326 to be discrete continuous bonds.

The surface area of the ultrasonic bonds 326, the surface area of the unbonded areas of the flange 314, and the overall surface area of the flange 314 may be balanced to provide for an effective seal and reduce potential severing of the flange 314 and the cover 306. For example, each ultrasonic bond 326 along the longitudinal sides of the container 300 may have a surface area in a range of about 1.375 $in^2$ to about 5.75 $in^2$ and each ultrasonic bond 326 along the transverse sides of the container 300 may have a surface area in a range of about 1 $in^2$ to about 4 $in^2$. In addition, the surface area of the space between the respective ultrasonic bonds 326 may be less than about 0.140 or in a range of about 0.02 to about 0.120. A ratio of the surface area of the ultrasonic bonds 326 to the surface area of the flange 314 may be in a rage of about 0.5 to about 1 or about 0.2 to about 0.8. A ratio of the surface area of the ultrasonic bonds 326 to the surface area of the space between the ultrasonic bonds 326 may be in a rage of about 0.5 to about 1 or about 0.6 to about 0.8. In other suitable embodiments, the ultrasonic bonds 326 may have different sizes and positions than those described without departing from some aspects of the disclosure.

The ultrasonic bonds 326 may have a thickness that is less than the thickness of the unbonded portions of the flange 314 and the cover 306 collectively. For example, in some areas, each of the flange 314 and the cover 306 includes a single layer and the unbonded portions may have a thickness in a range of about 0.015 in. to about 0.02 in. or about 0.016 in. to about 0.018 in. In other areas of the container 300, the cover 306 and the flange 314 form a structure including three layers and the unbonded portions may have a thickness in a range of about 0.045 in. to about 0.06 in. or about 0.048 in. to about 0.054 in. The ultrasonic bonds 326 in the area of the flange 314 and the cover 306 where each of the flange 314 and the cover 306 includes a single layer may have a thickness in a range of about 0.015 to about 0.02. The ultrasonic bonds 326 in the areas of the flange 314 and the cover 306 where the flange 314 and the cover 306 form a structure including three layers may have a thickness in a range of about 0.028 to about 0.037. A ratio of the thickness of the ultrasonic bonds 326 to the thickness of the unbonded portions of the flange 314 and the cover 306 may be in a range of about 0.83 to about 0.88 in areas where each of the flange 314 and the cover 306 includes a single layer. A ratio of the thickness of the ultrasonic bonds 326 to the thickness of the unbonded portions of the flange 314 and the cover 306 may be in a range of about 0.62% to about 0.69% in areas where the flange 314 and the cover 306 form a structure including three layers.

In the illustrated embodiment, the tray 310 and the cover 306 are constructed from suitable paperboard. For example, the tray 310 and/or cover 306 may be cut and/or folded from paperboard blanks. In other embodiments, the container 300 may be constructed from other suitable materials without departing from some aspects of the disclosure. For example, the tray 310 and/or the cover 306 may include paperboard, plastic, cardboard, closed-cell extruded polystyrene foam, films, and/or combinations thereof.

Figure 6:
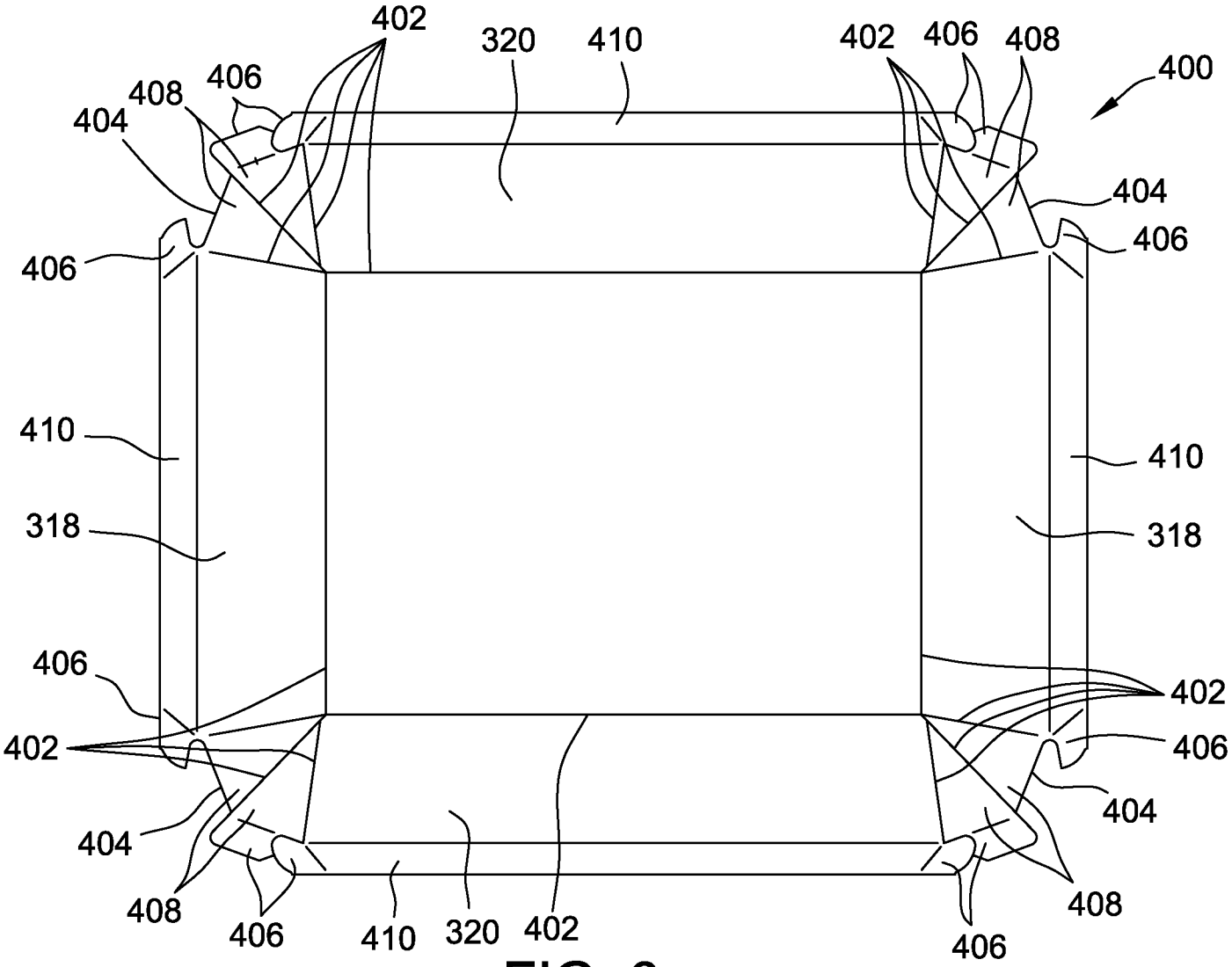
FIG. 6 is a top view of a paperboard blank used to assemble a tray of the container of FIG. 1.

With reference now to FIGS. 6 and 7, an example of a paperboard blank that may be used to assemble the tray 310 is indicated generally by 400. The paperboard blank 400 is provided in a flat configuration and may be cut from a supply of paperboard. The blank 400 is configured to be folded into the tray shape. For example, the blank 400 includes fold lines 402 and notches 404 to facilitate folding the blank. The notches 404 may be formed in the blank or cut away. The fold lines 402 may be formed by weakening and/or partially cutting (e.g., scoring) the blank. The blank 400 may be folded along the fold lines 402 into a folded configuration. The blank 400 is secured in the folded configuration to form the tray 310. The paperboard blank 400 may be secured in the folded configuration using adhesives, mechanical attachments, fasteners, and any other suitable attachment devices. In some embodiments, the paperboard blank 400 may be at least partially secured in the folded configuration by ultrasonic bonds. In other embodiments, the tray 310 may be assembled in any manner that enables the tray 310 to function as described herein.

The blank 400 also includes tabs 406 and webs 408. The tabs 406 extend from the webs 408 and/or the flange portions 410. The tabs 406 are configured to overlap each other and/or the flange portions 410 when the tray 310 is in the folded configuration. In addition, the tabs 406 may extend into the notches 404 and engage each other and/or the flange portions 410 to at least partially secure the tray 310 in the folded configuration. Each web 408 extends between a pair of planar portions 318, 320. The web 408 at least partially overlaps the portions 318, 320 when the tray 310 is in the folded configuration. In some embodiments, the tabs 406 and/or the web 408 may be omitted.

The tray 310 (shown in FIG. 5) may have an increased thickness in locations where the tabs 406 overlap the flange portions 410 and the web 408 overlaps the planar portions 318. For example, the tray 310 (shown in FIG. 5) may have a double-layer thickness (i.e., the thickness is twice the thickness of a single layer) in areas where the tabs 406 or the webs 408 overlap the flange 314 and/or the planar portions 318, 320. In other suitable embodiments, the tabs 406 and the web 408 may not overlap other portions of the tray 310 (shown in FIG. 5). In further embodiments, the tray 310 (shown in FIG. 5) may have areas of overlap that include three or more layers of the paperboard blank 400.

In suitable embodiments, the flange 314 may have a minimum thickness in areas where the flange includes a single layer of paperboard and a maximum thickness in areas where the flange includes two or more layers of paperboard. For example, the minimum thickness may be in range of about 0.015 in. to about 0.020 in. or about 0.016 in. to about 0.018 in. and the maximum thickness may be in a range of about 0.045 in. to about 0.060 in. or about 0.048 in. to about 0.054 in. In the illustrated embodiment, the flange 314 has a minimum thickness of approximately 0.000016 in. and a maximum thickness of approximately 0.000032 in.

With reference to FIGS. 1-4, the cover 306 may be formed from a single layer of the paperboard. Accordingly, the cover 306 may have a thickness, for example, in a range of about 0.015 in. to about 0.020 in. or about 0.016 in. to about 0.018 in. In the illustrated embodiment, the cover 306 has a thickness of approximately 0.016 in.

When the container 300 is assembled as shown in FIG. 1, the cover 306 is positioned on the tray 310 and rests on the flange 314. The cover 306 and the flange 314 are bonded together in a stacked configuration. Accordingly, the bonding area of the container 300 has a thickness that includes the thickness of the cover 306 and the flange 314 and the thickness of the bonding area may include at least two layers of paperboard material. The thickness of the bonding area may include three or more layers of paperboard material where the cover 306 and/or the flange 314 include overlapping portions. The ultrasonic bonding process described herein is configured to provide effective bonding in areas including two, three, or more layers of paperboard material. For example, a nip defined between ultrasonic bonding apparatus may have a thickness that enables bonding of two or more layers of paperboard material without severing the material.

Figure 8:
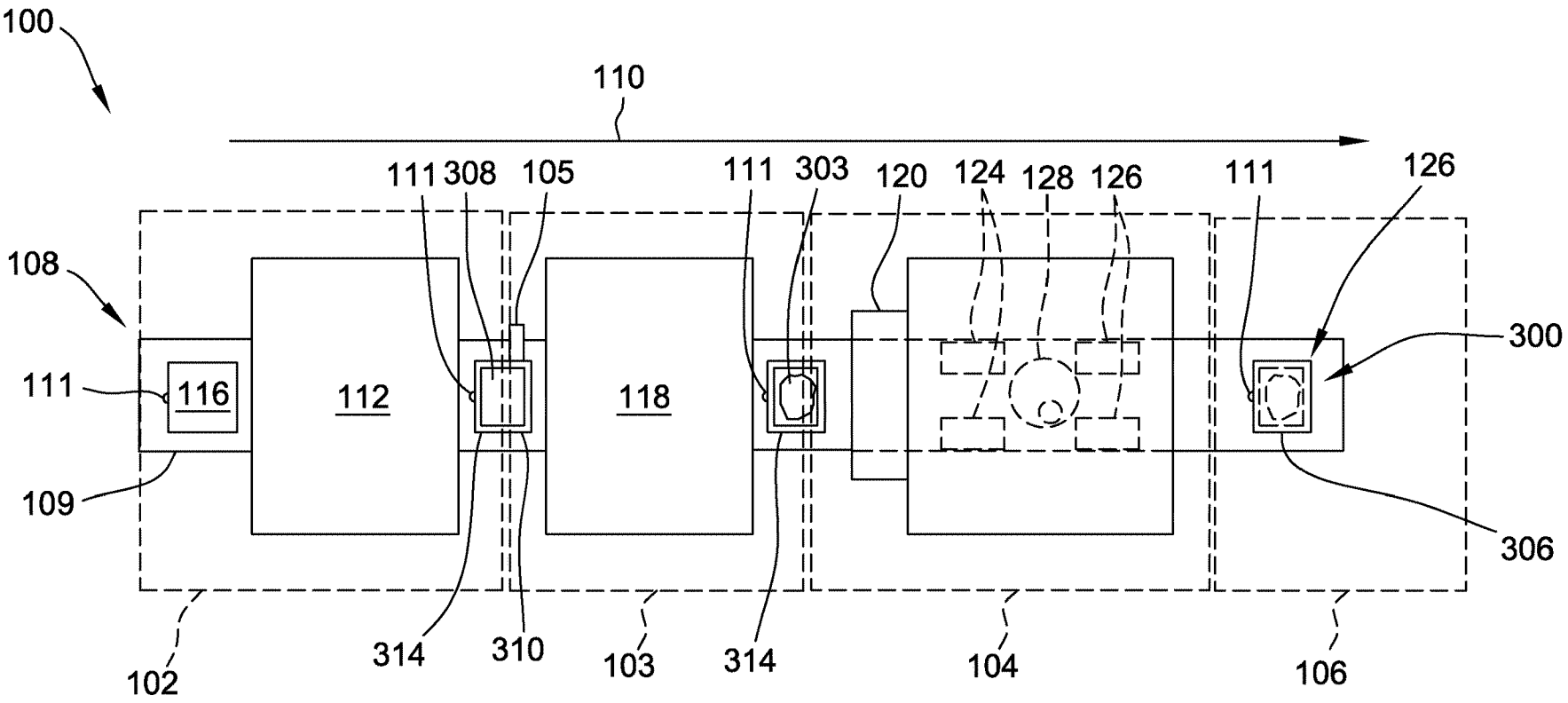
FIG. 8 is a schematic of a system for packaging food product in a container such as the container of FIGS. 1-5.
Figure 9:
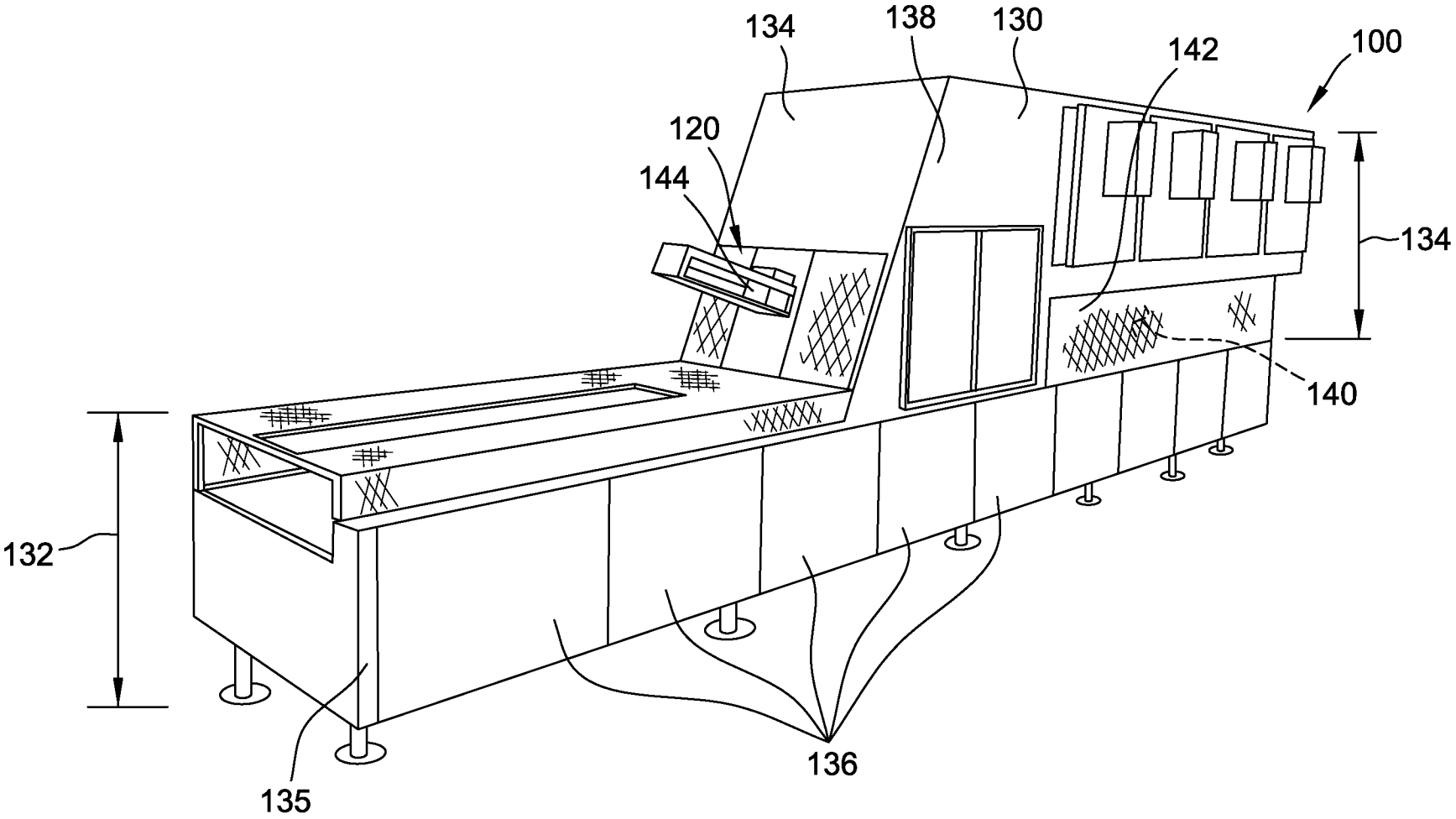
FIG. 9 is a front perspective view of a portion of the system shown in FIG. 8.
Figure 10:
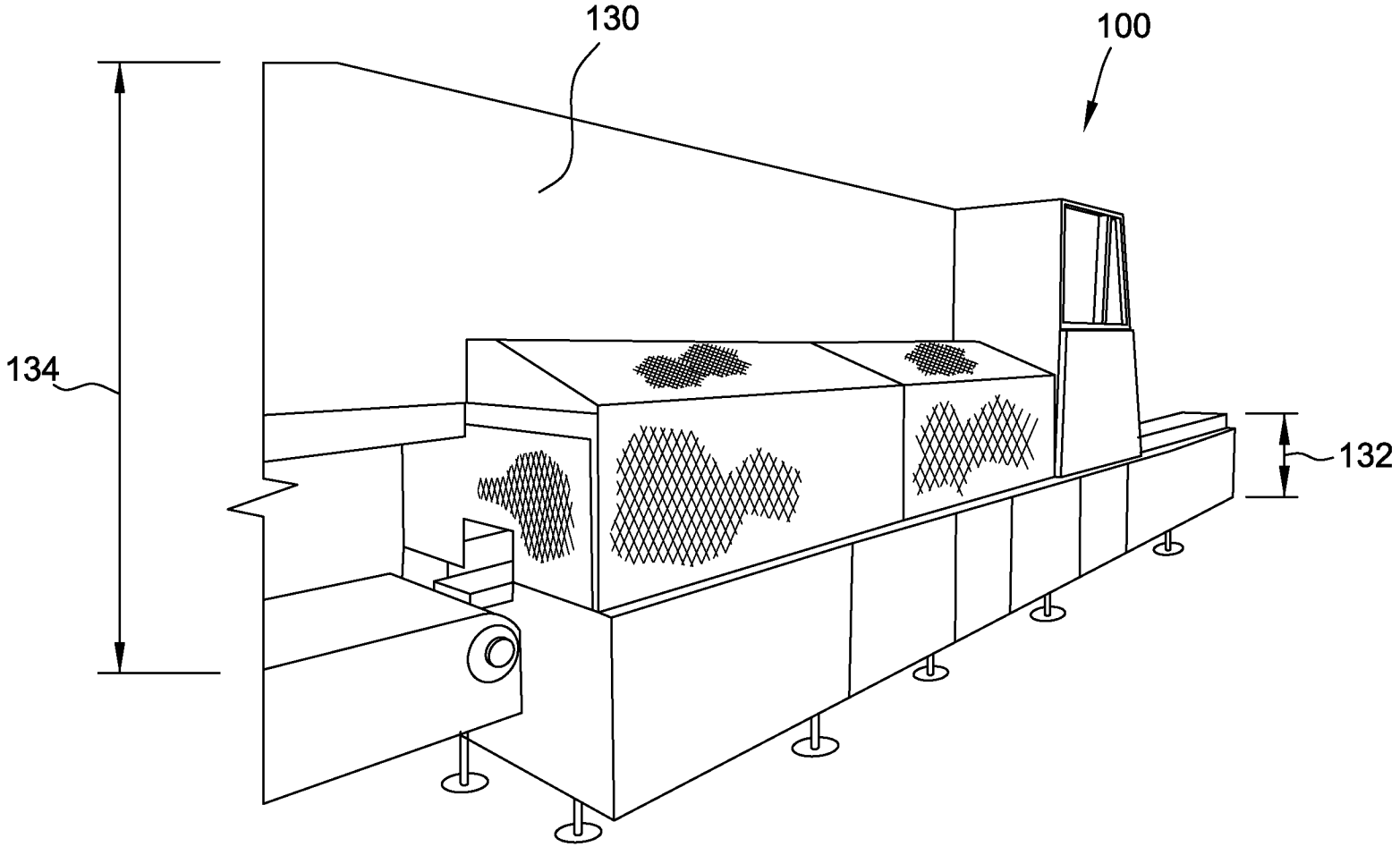
FIG. 10 is a rear perspective view of a portion of the system shown in FIGS. 8 and 9.

Referring to FIGS. 8-10, one suitable of embodiment of a system for packaging a food product in the container 300 is indicated generally by 100. The illustrated system 100 generally includes, moving left to right as viewed in FIG. 8, a supply station indicated at 102, a food delivery station indicated at 103, a sealing station indicated at 104, and a collection station indicated at 106. Other suitable stations are also contemplated without departing from the scope of this disclosure.

The system 100 also includes a conveyance apparatus 108 for transporting articles between the stations 102, 103, 104, 106. The conveyance apparatus 108 may be configured to transport any suitable articles. For example, the conveyance apparatus 108 may transport containers 300, portions of the containers (e.g., trays 310 and covers 306), and/or precursors of the containers. In the illustrated embodiment, the stations 102, 103, 104, 106 are positioned in succession along the conveyance apparatus 108 and the conveyance apparatus 108 transports the articles in a machine direction 110 between the stations. In other embodiments, the stations 102, 103, 104, 106 may be positioned differently relative to each other without departing from some aspects of the disclosure. In addition, the system 100 may include more than one conveyance apparatus 108 for transporting the articles between the stations 102, 103, 104, 106.

In the illustrated embodiment, the conveyance apparatus 108 includes a track 109 and engagement members 111, and a motor (not shown in FIG. 8). The engagement members 111 are for engaging the transported articles and moving the article along the track 109. For example, in the illustrated embodiment, each engagement member 111 comprises a pin that contacts a rearward, in respect to the machine direction 110, portion of the container 300. The conveyance apparatus 108 pushes the containers 300 along the track via the engagement members 111. Each engagement member 111 has a height greater than the depth of the container 300 and is arranged to contact the flange 314 of the tray 310. Accordingly, the engagement members 111 may help align the cover 306 and the flange 314. In addition, the conveyance apparatus 108 may include one or more sensors 105 configured to detect positions of transported articles. In other embodiments, the conveyance apparatus 108 may have other configurations without departing from some aspects of the disclosure. For example, in some embodiments, the engagement members 111 may be omitted. In the illustrated embodiment, the engagement members 111 are carried by a continuous chain that moves the engagement members 111 in the machine direction 110 from the start of the track 109 to the end and then back to the start. The engagement members 111 contact the trailing edge of the flange 314 and/or cover 306 as the engagement members 111 move in the machine direction 110.

The supply station 102 includes a forming apparatus 112. In the illustrated embodiment, the forming apparatus 112 is configured to form trays 310 from precursor material 116 such as paperboard. In suitable embodiments, the trays 310 may be made from other precursor materials including, for example and without limitation, plastic and closed-cell extruded polystyrene foam. The forming apparatus 112 is configured to fold and secure the precursor material 116 into the desired shape. As described above, each tray 310 includes an end wall and a sidewall defining the open cavity 308 to receive food product. The forming apparatus 112 may utilize adhesive and/or bonding materials to form the trays 310. In other embodiments, the trays 310 may be provided in any suitable manner. For example, in some embodiments, the trays 310 are at least partially assembled before reaching the supply station 102 and the supply station includes a positioning apparatus to position the at least partially formed trays 310 onto the conveyance apparatus 108.

The trays 310 provided at the supply station 102 are transported by the conveyance apparatus 108 to the food delivery station 103. A sensor 105 may detect when the trays 310 are at the food delivery station 103 or another location along the conveyance apparatus 108. The sensor 105 may be a mechanical sensor, an optical sensor, an acoustic sensor, or any other type of sensor. When a tray 310 is detected by the sensor 105, the system 100 may determine the position of the tray 310 and project the path of the tray 310 through the stations based on a speed of the conveyance apparatus 108. Operations at each station may be timed to occur when the trays 310 arrive at the station based on the determined transport time from the detected position of the tray to the respective station. In some embodiments, multiple sensors 105 may be positioned along the system 100. In some embodiments, trays 310 may be removed from the conveyance apparatus 108 if the trays 310 are off-track.

The food delivery station 103 includes a delivery apparatus 118 for depositing a food product 303 into the cavities 308 of the trays 310. The food product 303 may include any suitable food including liquids and/or solid materials. In one suitable embodiment, a single prepared food product 303 may be deposited within the cavity 308. Alternatively, more than one food product may be deposited within each cavity 308. Different food products 303 may be separated within the cavity 308 and/or allowed to contact each other within the cavity. The delivery apparatus 118 may include nozzles and/or tools to dispense the food product(s). The food delivery apparatus 118 may be configured to deposit the food product 303 within a specified portion of the cavity. Sometimes, at least a portion of the food product 303 may be deposited outside the cavity and/or on a portion of the tray 310 arranged to bond with the cover 306. Suitably, the ultrasonic bonding process described herein is able to form an ultrasonic bond even with food product 303 positioned on the bonding area. Accordingly, time required to deposit the food product 303 and to address any misplaced food product is reduced.

After the food product 303 is deposited into the cavities 308 of the trays 310, the trays 310 are transported by the conveyance apparatus 108 to the sealing station 104. The sealing station 104 includes a positioning apparatus 120 for positioning covers 306 relative to the trays 310. The positioning apparatus 120 is configured to position each cover 306 on a respective tray 310 to cover an open end of the tray and overlap the flange of the tray.

Figure 11:
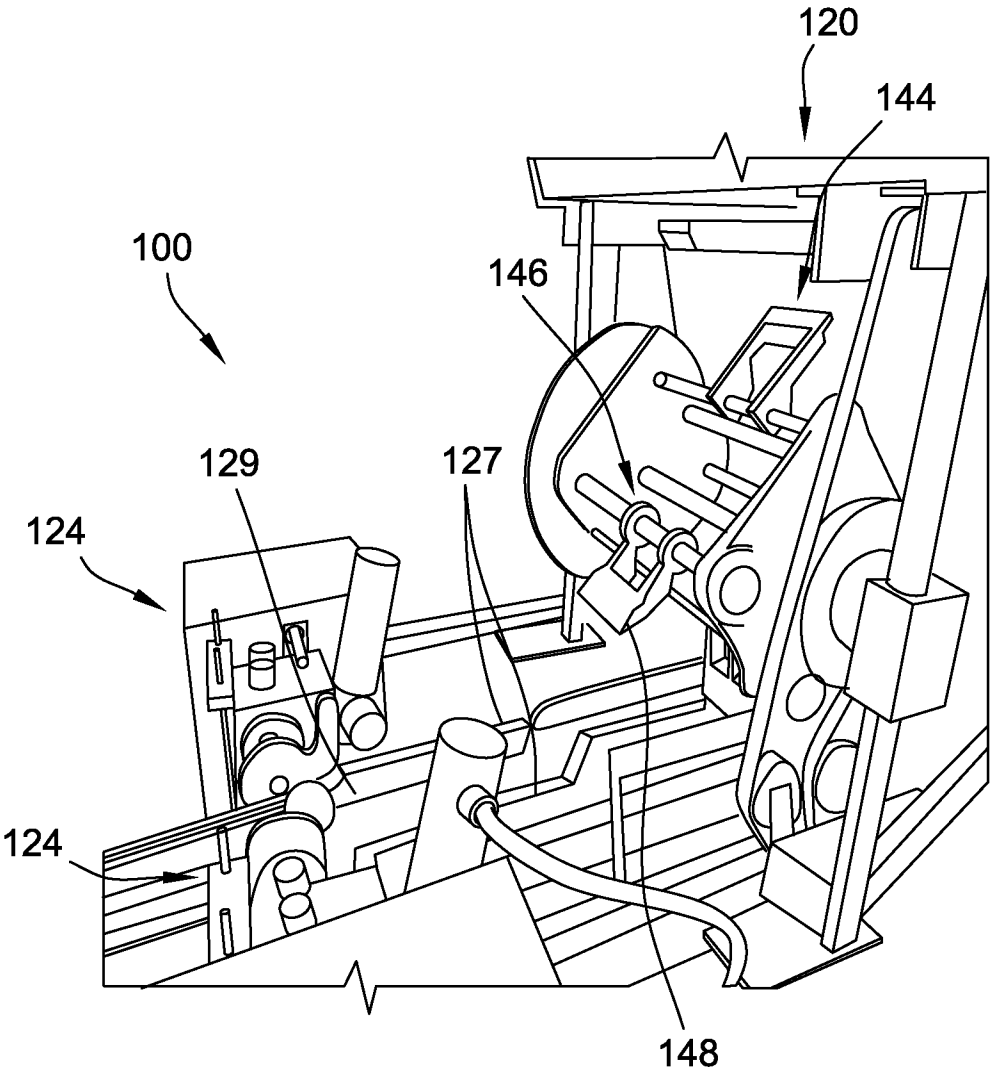
FIG. 11 is an enlarged perspective view of a portion of the system shown in FIGS. 8-11, and including a positioning apparatus and a bonding apparatus.

As seen in FIG. 11, the positioning apparatus 120 includes a hopper 144 to hold the covers 306 and a dispenser 146 to dispense the covers from the hopper. The covers 306 may be loaded into the hopper 144 manually or at least partially automatically from a supply of covers. In addition, the hopper 144 extends to the exterior of the housing 130 to allow loading of the hopper from the exterior. The dispenser 146 may include a positioning tool 148 to precisely position each cover 306 relative to a respective tray 310 on the track of the conveyance apparatus 108. In the illustrated embodiment, the positioning tool 148 includes suction devices for gripping a respective cover 306 and positioning it on the tray 310. A single cover 306 may be fed to the positioning tool 148 by gravity or other suitable means when the respective tray 310 is in position. The positioning tool 148 may press the cover 306 onto the tray 310 until the cover 306 is secured to the tray 310. In some embodiments, adhesive may be used to retain the cover 306 in position on the tray 310 until the ultrasonic bonds are formed. In other embodiments, the configuration of the positioning apparatus 120 may be different without departing from some aspects of the disclosure. For example, in some embodiments, the positioning tool 148 is omitted and the cover 306 is dispensed from the hopper 144 directly onto the tray 310 in a desired position.

The cover 306 and the tray 310 may be aligned as the container 300 is carried by the conveyance apparatus 108. For example, the engagement members 111 may contact the trailing edges of both the cover 306 and the tray 310 to align the trailing edges flush to each other as the conveyance apparatus 108 moves the containers 300 in the machine direction 110. Guide members 127 may contact and align the cover 306 and the tray 310 in the cross-machine direction as the cover 306 and the tray 310 move in the machine direction 110. In other embodiments, the cover 306 and the tray 310 may be aligned in any manner that enables the system 100 to operate as described herein.

The sensor 105 may be positioned to detect the cover 306 and/or the tray 310 and determine the alignment of the cover 306 and the tray 310. In some embodiments, the trays 310 and the covers 306 may be removed from the conveyance apparatus 108 if the cover 306 and the tray 310 are incorrectly aligned based on information from the sensor 105.

Figure 12:
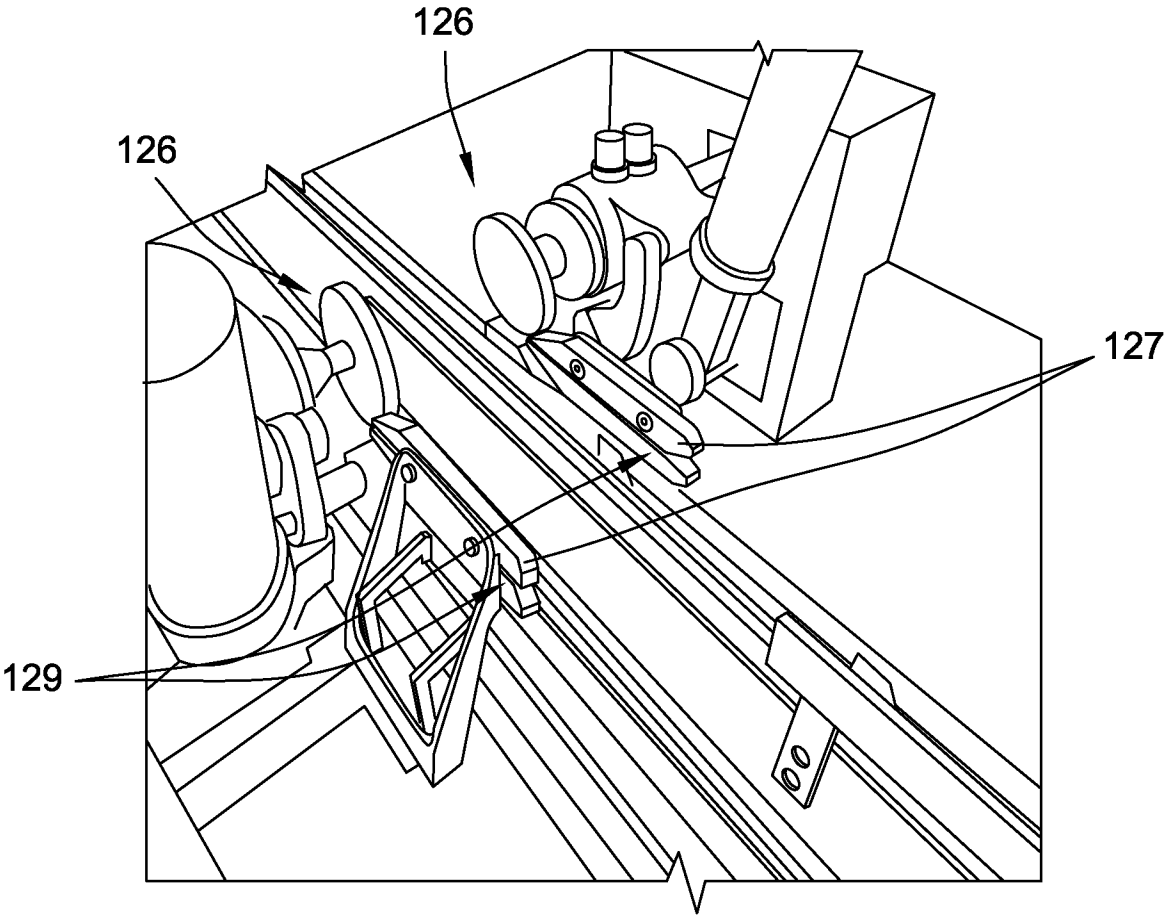
FIG. 12 is an enlarged perspective view of a bonding apparatus of the system shown in FIGS. 8-11.

Referring to FIGS. 11 and 12, the sealing station 104 also includes a plurality of ultrasonic bonding apparatus 124, 126 configured to deliver ultrasonic energy to at least one of the cover 306 and the tray 310 to bond the cover to the tray. Specifically, in the illustrated embodiment, the sealing station 104 includes four ultrasonic bonding apparatus 124, 126. The ultrasonic bonding apparatus 124, 126 are arranged in pairs along the conveyance apparatus 108. Each ultrasonic bonding apparatus 124, 126 may have first and second bonding modules, e.g., an anvil module and a horn module, that cooperate to perform a bonding operation for the container as set forth in more detail below.

Guide members 127 extend along the track 109 on opposites sides of the track 109 between the positioning apparatus 120 and the first pair of ultrasonic bonding apparatus 124. The guide members 127 include grooves 129 sized to receive the cover 306 and the flange 314. Accordingly, the guide members 127 retain the cover 306 on the tray 310, laterally align the cover on the tray, and direct the container 300 (i.e., the tray 310 with the cover 306 resting thereon) towards the first pair of ultrasonic bonding apparatus 124. The grooves 129 are positioned above the track 109 at a distance that is substantially equal to the height of the sidewall 304. In addition, the grooves 129 are aligned with the nips of the ultrasonic bonding apparatus 124. Accordingly, the guide members 127 align the containers 300 with the bonding apparatus 124 and enable a precise ultrasonic bond to be formed.

The first pair of ultrasonic bonding apparatus 124 includes a first ultrasonic bonding apparatus including a first bonding module and a second bonding module and a second ultrasonic bonding apparatus including a third bonding module and a fourth bonding module. The second bonding module is positionable in close proximity to the first bonding module to define a nip therebetween. The fourth bonding module is positionable in close proximity to the third bonding module to define a nip therebetween. The first and second bonding modules are positioned on a first side of the conveyance apparatus 108 and the third and fourth bonding modules are positioned on a second side. Accordingly, the ultrasonic bonding apparatus 124 are configured to ultrasonically bond the container 300 along opposite sides of the container simultaneously. In the illustrated embodiment, the first and second bonding modules are spaced from the third and fourth bonding modules by a distance equal to approximately the width of the container 300. Accordingly, the bonding apparatus 124 are configured to provide ultrasonic bonds extending along the entire longitudinal sides of the container 300.

The first pair of ultrasonic bonding apparatus 124 is configured to receive the flange 314 and the cover 306 of each container in the nip between the respective bonding modules. Each nip is sized to allow the respective bonding modules to deliver sufficient energy to form the ultrasonic bond without severing the flange 314 and/or the cover 306. If the respective bonding modules are moved closer, i.e., the distance between the bonding modules is decreased, the strength of the ultrasonic bond is increased. However, the flange 314 and/or the cover 306 may be at least partially severed if the respective bonding modules are positioned too close together. In addition, maintaining a minimum spacing between the respective bonding modules reduces wear on the bonding modules and prolongs the expected service life of the ultrasonic bonding apparatus 124.

In the illustrated embodiment, the distance between bonding modules, i.e., the thickness of the nip, is determined based at least in part on the material used to assemble the container 300 and is configured to provide a complete ultrasonic bond without damaging the container 300. In the illustrated embodiment, each nip has a thickness less than 0.03 in. or in a range of about 0.01 in. to about 0.02 in.

Further, the cover 306 and/or the flange 314 may include varying thicknesses due to the overlap of materials. Accordingly, the nip spacing must be configured to provide bonding for different layers of material in different areas of the flange 314 and/or cover 306 without damaging any of the layers. As a result, the nip thickness must be precisely determined based on factors including number of layers, type of material, thickness, desired bonding strength, nip width, bond width, and any other suitable factors. For example, a ratio of the nip thickness to a maximum thickness of the flange 314 may be about 0.62 to about 0.69 and a ratio of the nip thickness to a minimum thickness of the flange 314 may be about 0.82 to about 0.88. In some suitable embodiments, the nip thickness is not necessarily directly proportional to the number of layers or the thickness of the material and each nip thickness must be determined independently based on the relevant factors.

In addition, the bonding modules may provide a bonding pressure to at least two of the layers that enables the bonding modules to bond the layers without severing material. The bonding pressure may be may be in a range of about 100 pounds per square inch (psi) to about 150 psi for two layers of material and in a range of about 150 psi to about 200 psi for three layers of material. The ratio of the bonding pressure for two layers of material to the bonding pressure for three layers of material may be about 0.66 or about 0.75. In other suitable embodiments, the bonding modules may provide other bonding pressures without departing from some aspects of the disclosure.

After the ultrasonic bonds are formed along the first sides of the container 300 (i.e., the longitudinal sides in the illustrated embodiment), the container are rotated to allow ultrasonic bonds to be formed along the other sides of the container (i.e., the transverse sides in the illustrated embodiment). For example, a rotation mechanism 128 may be positioned between the first pair of ultrasonic bonding apparatus 124 and the second pair of ultrasonic bonding apparatus 126. The rotation mechanism 128 may include a pin or engagement member that contacts the container 300 along an edge of the container 300 at a location off center of the container 300 as the conveyance apparatus 108 transports the container 300 in the machine direction to cause the container 300 to rotate. In the illustrated embodiment, each container 300 is rotated approximately 90° such that the transverse sides extend along the machine direction when the container reaches the second bonding apparatus 126.

A contact member may contact the container 300 to prevent the container 300 from flipping over and to prevent the cover 306 and the tray 310 from coming apart during rotation. For example, the contact member may comprise at least one flexible elastic member that sets on the cover 306. In addition, guide members 127 may extend between the first pair of ultrasonic bonding apparatus 124 and the second pair of ultrasonic bonding apparatus 126 to guide the container 300 after and/or before the container 300 is rotated. In other embodiments, the containers 300 may be positioned in any manner that enables the system 100 to operate as described herein. In some embodiments, the containers 300 are not rotated and the bonding apparatus 124, 126 are configured to form ultrasonic bonds that extend in the machine direction and in a direction at an angle to the machine direction (e.g., the cross-machine direction).

The second pair of ultrasonic bonding apparatus 126 includes a third bonding apparatus including a fifth bonding module and a sixth bonding module, and a fourth bonding apparatus including a seventh bonding module and an eighth bonding module. The sixth bonding module is positionable in close proximity to the fifth bonding module to define a nip therebetween. The eighth bonding module is positionable in close proximity to the seventh bonding module to define a nip therebetween. The fifth and sixth bonding modules are positioned on a first side of the bonding apparatus and the seventh and eighth bonding modules are positioned on a second side. Accordingly, the second pair of bonding apparatus 126 is configured to ultrasonically bond the container 300 along opposite sides of the container 300 simultaneously. In the illustrated embodiment, the fifth and sixth bonding modules are spaced from the seventh and eighth bonding modules by a distance equal to approximately the length of the container 300. Accordingly, the second bonding apparatus 126 are configured to provide ultrasonic bonds extending along the transverse sides of the container 300.

The second pair of ultrasonic bonding apparatus 126 is configured to receive the flange 314 and the cover 306 of each container in the nip between the respective bonding modules. Each nip is sized to allow the respective bonding modules to deliver sufficient energy to form the ultrasonic bonds without severing the flange 314 and/or the cover 306. In the illustrated embodiment, each nip has a thickness less than about 0.03 in.

In addition, the containers 300 may be inspected to ensure compliance with quality control standards at an inspection station. For example, a contact member may press upon the cover 306 with a specified force to test the hermetic seal of each container 300. If one of the covers 306 is displaced a distance greater than a threshold value, the respective container 300 may be culled and discarded and/or the operation of the system 100 may be checked/adjusted. The ultrasonic bonding process described herein results in a reduced number of the containers 300 being culled at the inspection station in comparison to systems that utilize other sealing processes such as microwave processes. For example, the ultrasonic bonding process is believed to provide a more reliable seal and is able to seal through materials that are positioned on the flange 314 and/or cover 306. Moreover, the ultrasonic bonding process is configured to seal different thicknesses of the cover 306 and the flange 314 without damaging the container 300. As a result, the described processes reduce the amount of waste and decrease the cost to package food products in containers.

The sealed containers 300 are transported by the conveyance apparatus 108 from the sealing station 104 to the collection station 106. The sealed containers 300 may be treated to prepare and/or preserve the food product, e.g., flash frozen, after, at, or before the collection station 106. At the collection station 106, the containers 300 may be collected and/or processed for shipping. For example, labels may be added at the collection station 106. Moreover, the containers 300 may be sorted and/or packaged at the collection station 106.

Figure 13:
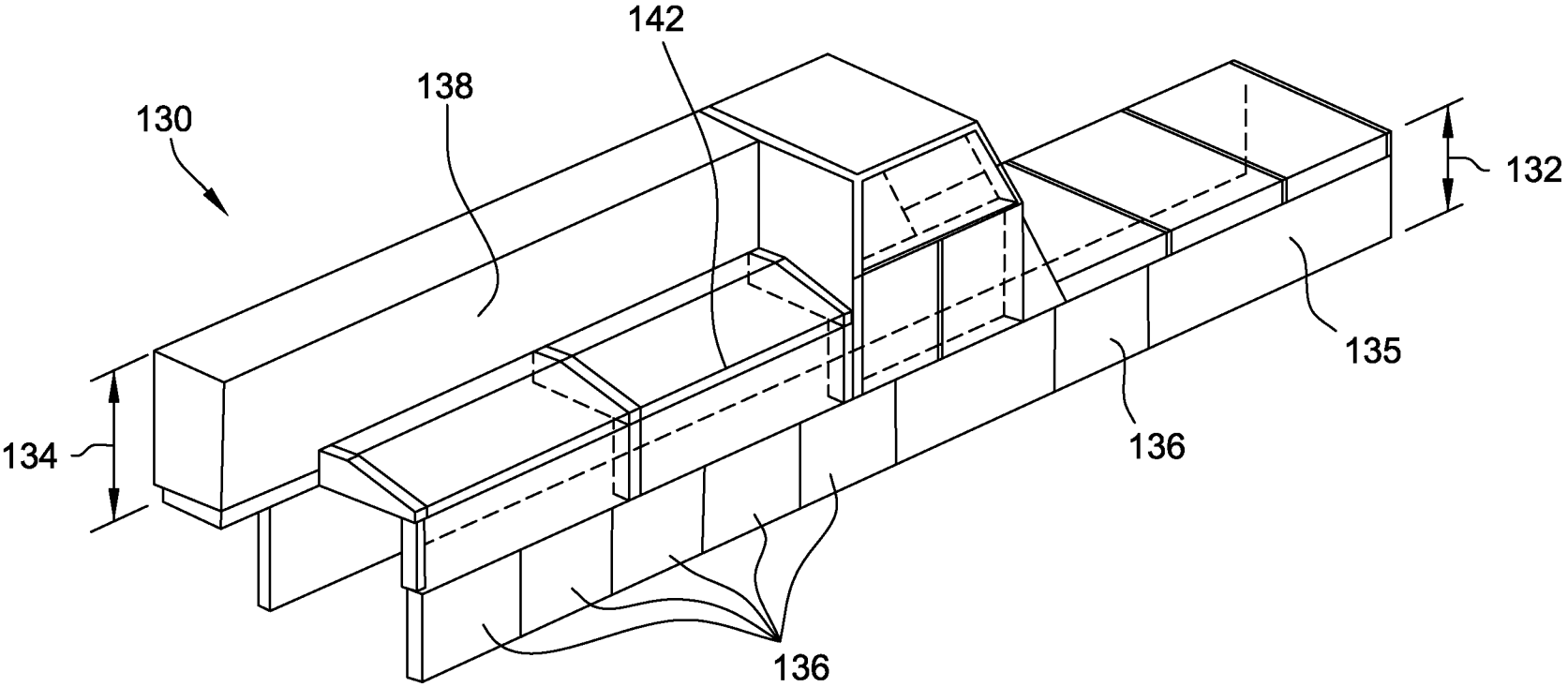
FIG. 13 is a perspective view of a portion of a housing of the system shown in FIGS. 8-10.

FIG. 13 is a schematic view of a portion of a housing (indicated generally by 130) of the system 100. The housing 130 may be constructed from materials that withstand regular cleaning of the system 100 and prevents the buildup of materials such as food products in cracks and crevices. For example, the housing 130 may be constructed of sheet metal panels that are connected along vertical edges.

The housing 130 includes a lower portion 132 and an upper portion 134. The lower portion 132 includes walls 135 that are arranged to extend along the conveyance apparatus 108 (shown in FIG. 8) on opposite sides. In addition, the walls 135 may define access openings that are covered by positionable doors 136.

The upper portion 134 includes walls 138 defining a cavity 140. The upper portion 134 may be configured to house apparatus of the system 100 such as the food delivery apparatus 118, the positioning apparatus 120, and/or the bonding apparatus 124. In the illustrated embodiment, the positioning apparatus 120 and the bonding apparatus 124 are coupled to the upper portion 134 and positioned within the cavity 140.

In addition, the housing 130 includes a guard 142 coupled to the upper portion 134 and the lower portion 132. The guard 142 extends over at least a portion of the track of the conveyance apparatus 108 and extends between the upper portion 134 and the lower portion 132. Suitably, the guard 142 allows visibility of objects transported by the conveyance apparatus 108. For example, the guard 142 may include a wire mesh. The guard 142 may include one or more doors providing access into the interior of the housing 130.

As a result, the housing 130 prevents objects from entering the assembly line and interfering with the packaging process. In addition, the housing 130 is configured to provide visibility of the process and allow access to the line when necessary. Moreover, the housing 130 provides support for and clearances about the various apparatus of the system 100 to enable proper functioning of the apparatus.

Figure 14:
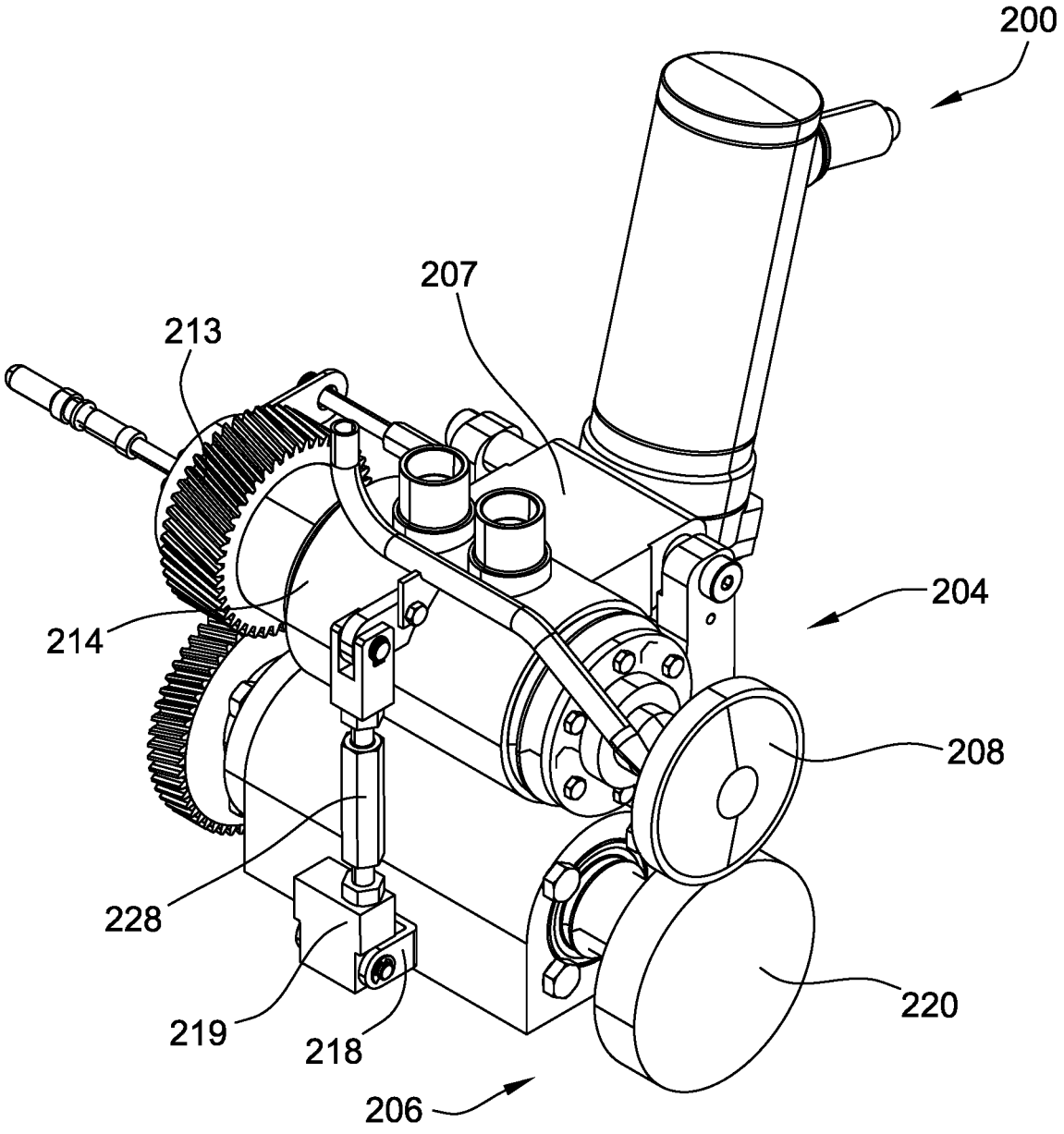
FIG. 14 is a perspective view of a bonding apparatus for use with the system shown in FIG. 8.
Figure 15:
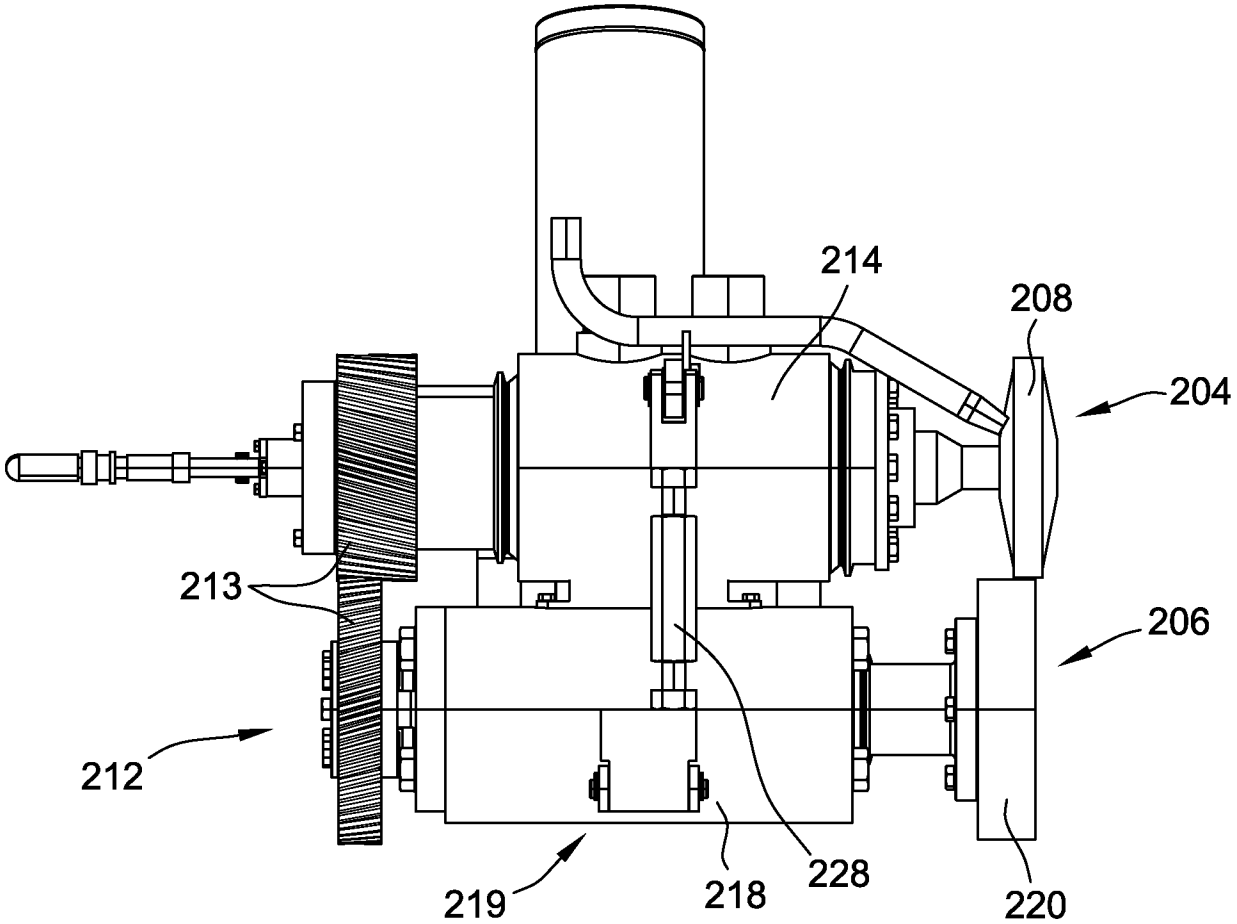
FIG. 15 is a front view of the bonding apparatus shown in FIG. 14.
Figure 16:
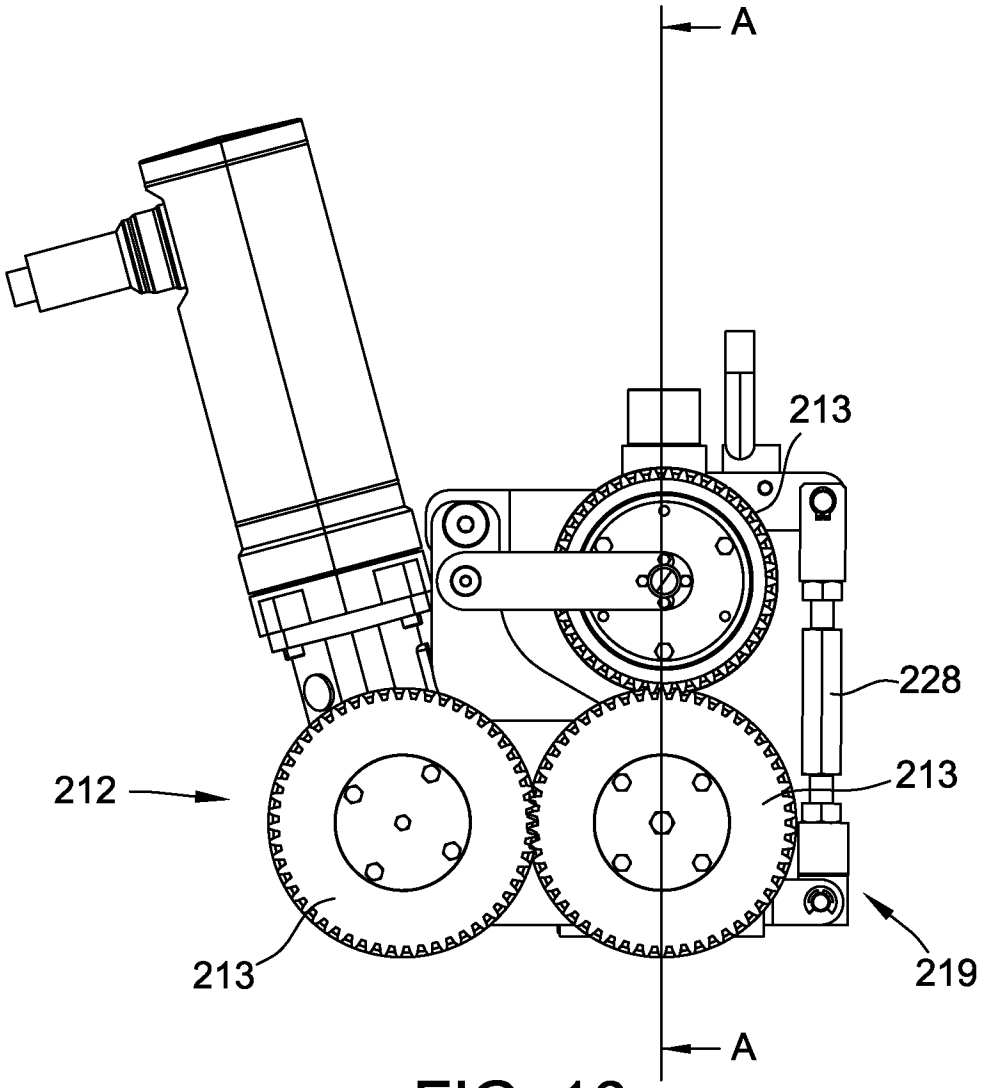
FIG. 16 is a first side view of the bonding apparatus shown in FIGS. 14 and 15.
Figure 17:
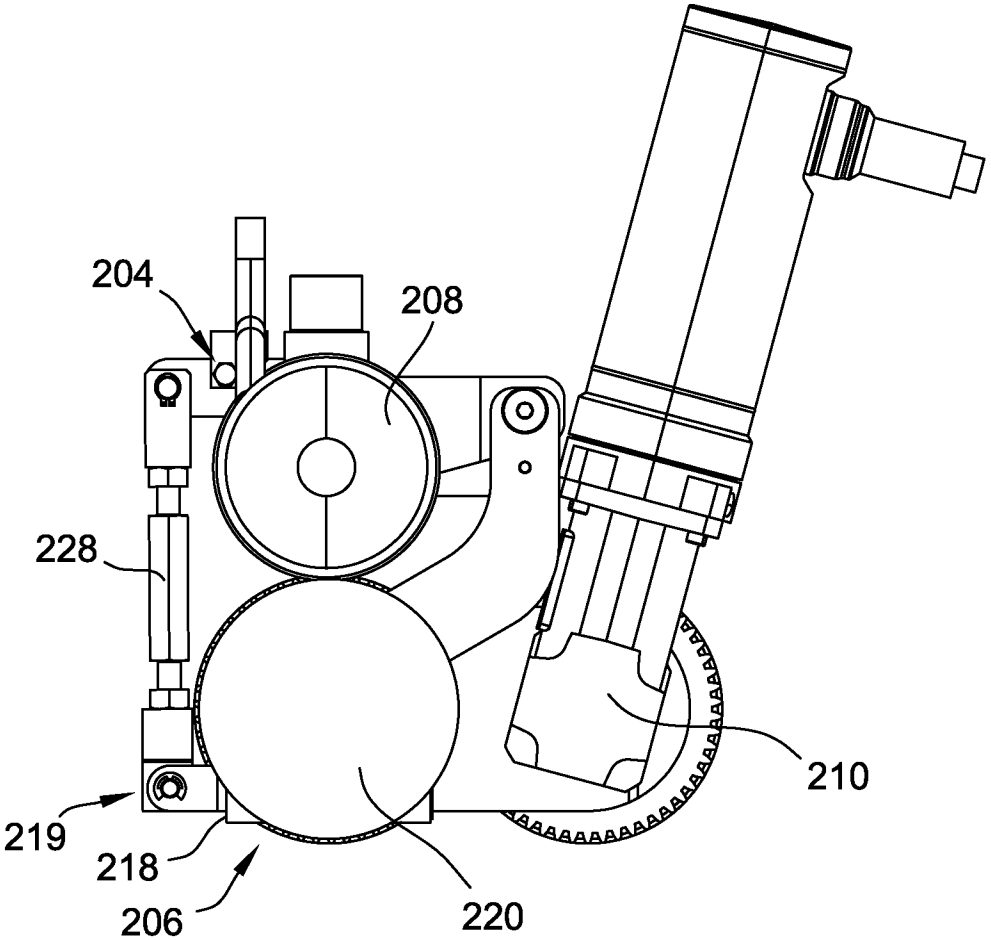
FIG. 17 is a second, opposite side view of the bonding apparatus shown in FIGS. 14-16.
Figure 18:
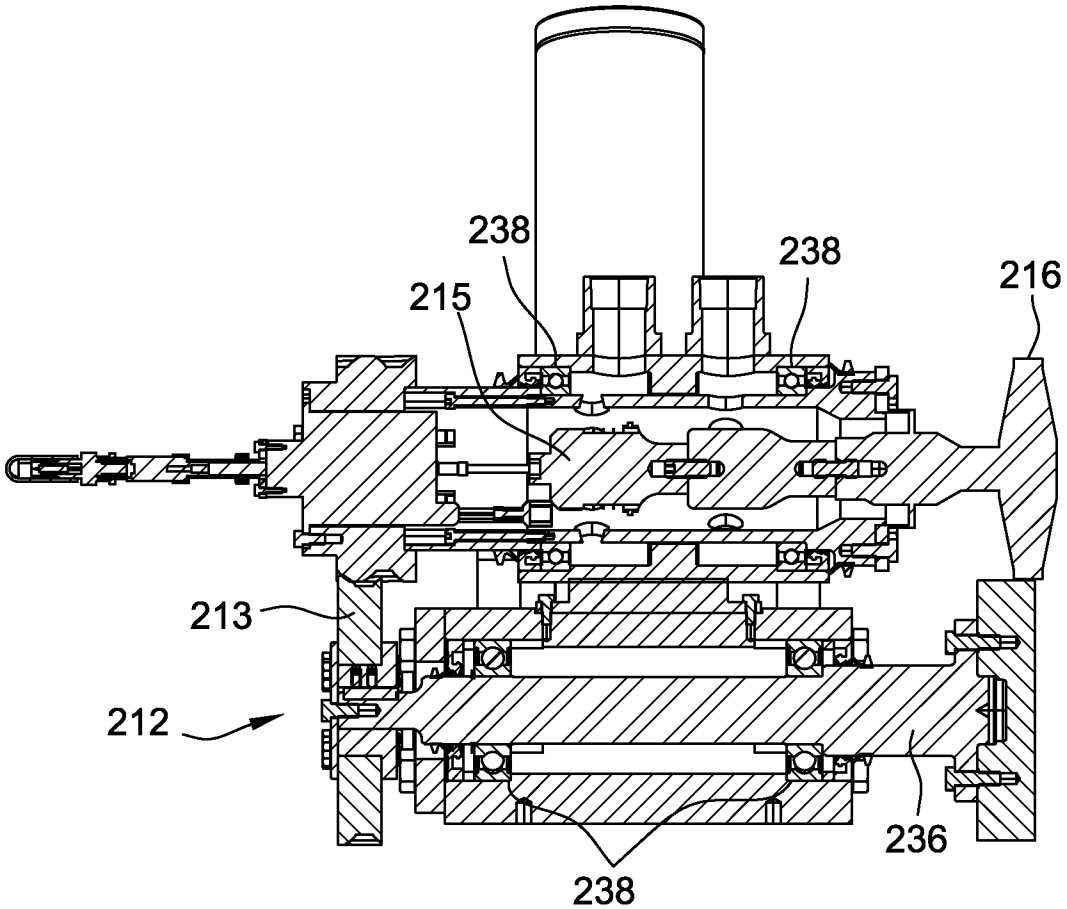
FIG. 18 is a section view of the bonding apparatus shown in FIGS. 14-17, taken along section line A-A of FIG. 16.

FIG. 14 is a perspective view of an ultrasonic bonding apparatus (indicated generally by 200) for use with the system 100 shown in FIGS. 1-4. FIG. 15 is a front view of the ultrasonic bonding apparatus 200. FIGS. 16 and 17 are side views of the ultrasonic bonding apparatus 200. FIG. 18 is a section view of the ultrasonic bonding apparatus 200 taken along section line A-A of FIG. 16. The illustrated ultrasonic bonding apparatus 200 is a rotary ultrasonic bonding apparatus for bonding the cover 306 to the flange 314 of the tray 310.

The ultrasonic bonding apparatus 200 includes a first bonding module 204, e.g., a horn module, and a second bonding module 206, e.g., an anvil module. The second bonding module 206 is positionable in close proximity to the first bonding module 204. The ultrasonic bonding apparatus 200 is configured to receive the flange 314 and the cover 306 of each container 300 (shown in FIG. 1) between the first bonding module 204 and the second bonding module 206. At least one of the first bonding module 204 and the second bonding module 206 vibrates at an ultrasonic frequency and delivers ultrasonic energy to the cover 306 (shown in FIG. 5) and the flange 314 (shown in FIG. 5) of the tray 310 (shown in FIG. 5) to hermetically seal the container 300 (shown in FIG. 5).

In the illustrated embodiments, the horn module 204 includes a frame 207 on which is mounted a disc-like rotary horn 208, and a housing 214 which contains at least part of a vibration control unit 215 that causes the horn 208 to vibrate. The horn 208 has a face 216 with a substantially continuous contour (i.e., the horn face 216 has a contour that is substantially smooth (or uninterrupted) across its entire surface area). In other embodiments, the horn face 216 may have any suitable contour that facilitates enabling the horn 208 to function as described herein.

In some embodiments, the vibration control unit 215 includes at least one booster (e.g., a drive booster and an integral booster) mechanically connected to a converter, which is electrically connectable to a generator. The converter is capable of converting high frequency electrical energy supplied by the generator into mechanical energy (or vibration) that is selectively transmitted to the horn 208 across the booster(s). The booster(s) are capable of modifying (i.e., increasing or decreasing) the vibration transmitted to the horn 208 from the converter, such that the horn 208 (particularly, the face 216 of the horn 208) vibrates while it rotates during a bonding operation, as set forth in more detail below. It is contemplated that the horn module 204 may have any suitable operational components arranged in any suitable manner that enable the horn 208 to function as described herein.

In the illustrated embodiments, the anvil module 206 includes a frame 218 on which is mounted a disc-like rotary anvil 220. The anvil 220 has an annular face 226, the contour of which is not continuous (i.e., is interrupted) as set forth in more detail below. The anvil 220 includes an outer side 232 and an inner side 234 spaced axially apart. The inner side 234 of the anvil 220 is coupled to a rotatable shaft 236 supported by bearings 238. The anvil module 206 is positioned relative to the horn module 204 such that the anvil face 226 is rotatable in close proximity to the horn face 216, and vice versa, to facilitate ultrasonically bonding the cover 306 to the tray 310. As used herein, the term "close proximity" refers to when the anvil face 226 is spaced from the horn face 216 by only the thickness of the nip when the horn 208 is not ultrasonically vibrating.

The ultrasonic bonding apparatus 200 includes a motor 210 for driving rotation of the horn 208 and the anvil 220 via a suitable drive train 212. The drive train 212 includes gears 213 that are connected to the horn 208 and the anvil 220 to cause the horn and the anvil to rotate when the motor 210 drives the drive train. The horn module 204 and the anvil module 206 each include bearings 238 that allow the horn 208 and the anvil 220 to rotate relative to the frames 207, 218. In addition, the bearings 238 of the horn module 204 support the housing 214 of the horn module such that the housing and at least a portion of the vibration control unit 215 are allowed to rotate with the horn 208.

In some embodiments, the ultrasonic bonding apparatus 200 may be configured such that at least one of the anvil module 206 and the horn module 204 is displaceable relative to the other via a suitable displacement mechanism 219 operable either: (A) when the system 100 is offline and the horn 208 is at rest (i.e., when the horn 208 is not rotating or vibrating); or (B) when the system 100 is online and the horn 208 is active (i.e., when the horn 208 is rotating and vibrating).

The apparatus 200 may be configured as a continuous-nip apparatus in which the horn module 204 is to be: (A) fixed in position relative to the anvil module 206 when the system 100 is online and the horn 208 is active; and (B) displaceable relative to the anvil module 206 when the system 100 is offline and the horn 208 is at rest. Such displacement is facilitated by a selectively actuatable pneumatic cylinder 228 (or other suitable linear actuator) that connects the frames 207, 218 to one another. In this manner, the spacing between the horn face 216 and the anvil face 226 is adjustable primarily for servicing the apparatus 200 when the system 100 is offline.

The apparatus 200 may also be configured as an intermittent-nip apparatus in which the horn module 204 is displaceable relative to the anvil module 206 when the system 100 is online and the horn 208 is active. In such an embodiment, the spacing between the horn face 216 and the anvil face 226, and/or the frequency at which the horn face 216 contacts the anvil face 226, are selectively adjustable. Other displaceable arrangements of the horn module 204 and the anvil module 206 are also contemplated without departing from the scope of this invention.

Notably, the apparatus 200 may have any suitable quantity of anvil modules 206 and/or horn modules 204 that cooperate with one another to facilitate enabling the apparatus 200 to function as described herein. For example, the apparatus 200 may be configured with an anvil drum in which a pair of anvils 220 are positioned such that the drum has a pair of predefined, annular faces 226 that are spaced apart from one another. In this manner, the horn 208 of a separate horn module 204 is dedicated to each such anvil face 226, thereby facilitating a bonding operation on confined regions of the cover 306 and/or the tray 310.

Figure 19:
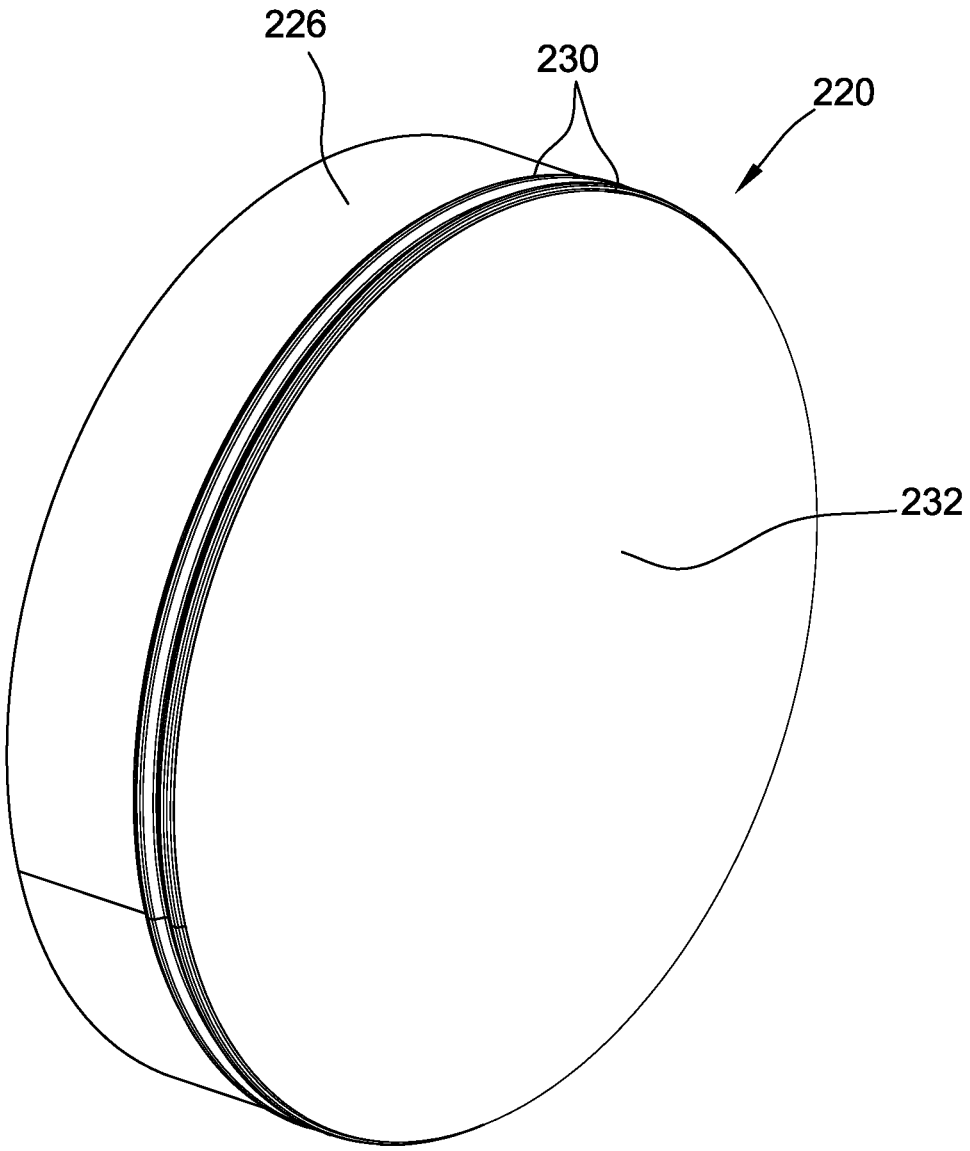
FIG. 19 is a perspective view of a bonding module of the bonding apparatus shown in FIGS. 14-18.
Figure 20:
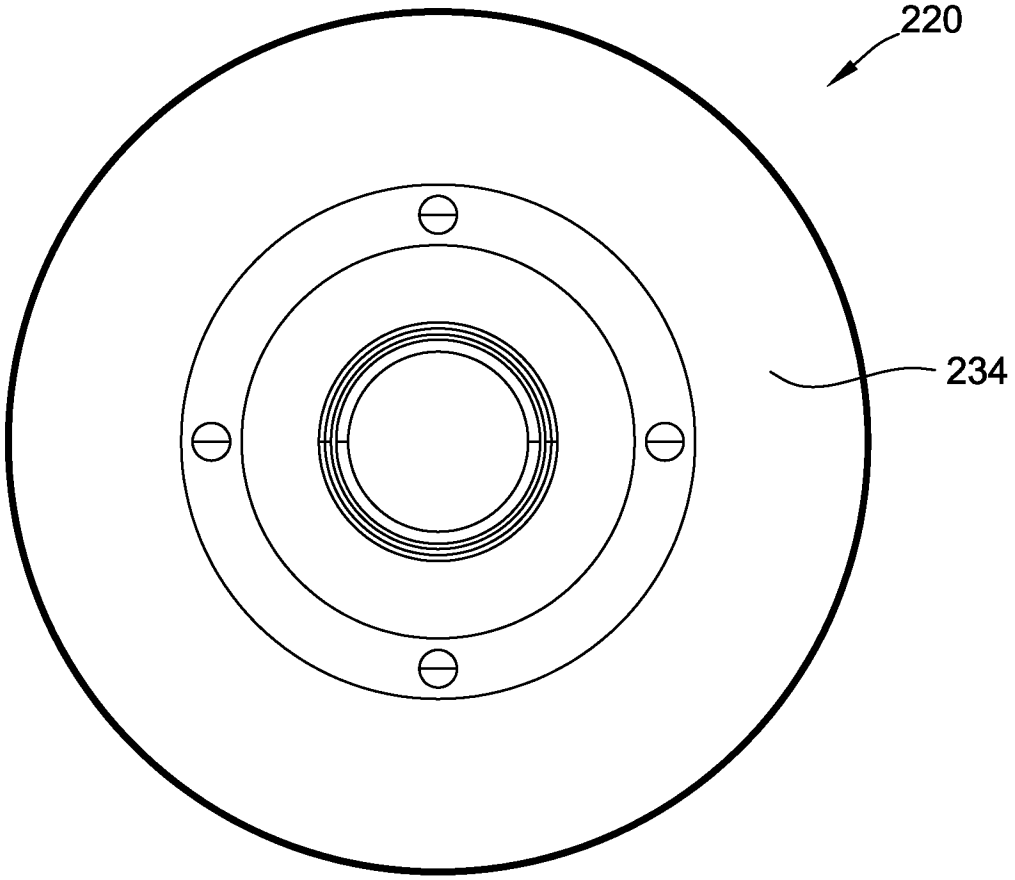
FIG. 20 is a side view of the bonding module shown in FIG. 19.
Figure 21:
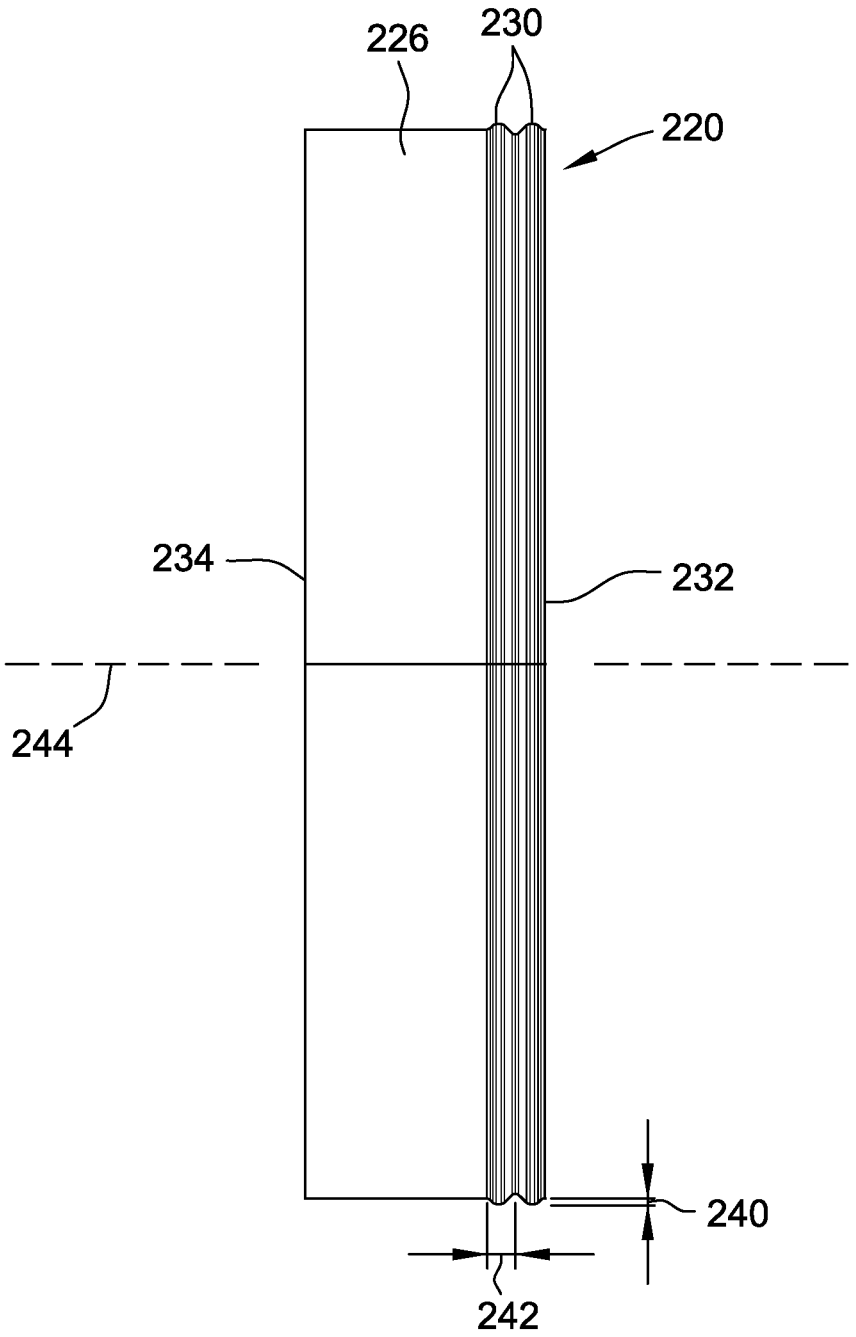
FIG. 21 is an end view of the bonding module shown in FIGS. 19 and 20.

With reference to FIGS. 19-21, the anvil face 226 includes at least one rib or projection 230 that extends circumferentially about the anvil 220. In the illustrated embodiment, the anvil face 226 includes two ribs 230 that extend circumferentially about the anvil 220 and are spaced apart axially. The ribs 230 are continuous, i.e., free from breaks or irregularities, such that the anvil face 226 is configured to form continuous seams along a bonded material. Continuous surfaces extend between the ribs 230, between the first, outer rib 230 and the outer side 232, and between the second, inner rib 230 and the inner side 232. The ribs 230 are located proximate an outer side 232 of the anvil 220 and are spaced from an inner side 234 of the anvil, i.e., the ribs 230 are closer to the outer side 232 than the inner side 234. For example, in the illustrated embodiment, the first, outer rib 230 is spaced from the outer side 232 by a distance in a range of about 0.032 in. to about 0.062 in. and the second, inner rib 230 is spaced from the inner side 234 by a distance in a range of about 0.70 in. to about 0.90 in. Accordingly, the ribs 230 are configured to align with the horn 208 when the system 100 is online and to interact with materials positioned in the nip between the anvil 220 and the horn 208.

Each rib 230 includes a height 240 and a width 242. The height 240 is defined between the extents of the rib 230 in a radial direction perpendicular to a rotational axis 244 of the anvil module 206. The width 242 is defined between the extents of the rib 230 along an axial direction parallel to the rotational axis 44. In the illustrated embodiment, each rib 230 is rounded and forms an apex at its midpoint between the axial extents. In other embodiments, the ribs 230 may have any shape, such as triangular or prismatic, that allows the anvil module 206 to function as described.

The height 240 of the ribs 230 may be in a range of about 0.022 in. to about 0.024 in. or in a range of about 0.0225 in. to about 0.0235 in. The width 242 may be in a range of about 0.1215 in. to about 0.125 in. or in a range of about 0.122 in. to about 0.123 in. In some suitable embodiments, a ratio of the height 240 to the width 242 may be in a range of about 0.18 to about 0.192 or about 0.184 to about 0.191. The position, shape, and size of the ribs 230 enables the apparatus 200 to have a predetermined nip size and to provide a predetermined bonding pressure to materials within the nip. Accordingly, the ribs 230 enable the apparatus 200 to precisely and reliably bond materials without damage to the materials.

The food packaging systems and methods set forth herein are utilized to package food within a container using an ultrasonic sealing process, thereby providing various functional and commercial advantages. For example, the systems and methods eliminate the use of microwaves to seal the containers. The systems and methods provide a simpler, cleaner, and safer (e.g., cooler in temperature) production environment, with lower power consumption and lower material costs. In addition, the need for supplemental apparatus such as cooling systems and compressed air systems is reduced. Moreover, the systems and methods set forth herein facilitate a more continuous production sequence (i.e., increased process uptime) due, at least in part, to the lack of: system reliability issues; heated equipment cool-down periods in advance of maintenance events; cold-start periods; and re-heat events. Further, the systems may be designed to allow for easier cleaning because the system includes materials that withstand chemicals and spraying and the system has a reduced number of crevices and seams in comparison to prior systems.

Also, the systems and methods provide a reliable and complete seal of the containers and reduce the labor required to seal the containers. For example, the ultrasonic bonding apparatus are able to seal the containers through food products and other materials on the container. Accordingly, the containers do not need to be cleaned prior to sealing. In addition, the ultrasonic bonds have a reduced risk of seal failure in comparison to seals formed using adhesives and microwaves.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A system for packaging a food product in a container, said system comprising:

a conveyance apparatus operable to move trays in a machine direction, each tray defining a cavity and including at least one wall and a flange extending from an edge of the wall, the flange having a single layer first area with a first thickness and a second area comprised of at least two layers with a second thickness, the second thickness being at least twice as thick as the first thickness;

a delivery apparatus operable to deposit the food product into the cavities of the trays;

a positioning apparatus operable to position covers relative to the trays, the cover having a cover thickness, wherein the positioning apparatus is configured to position each cover on a respective tray to overlap the flange of the respective tray, the cover and the tray forming the container; and an ultrasonic bonding apparatus comprising:

a first bonding module;

a second bonding module positionable in close proximity to the first bonding module to define a nip therebetween, wherein the ultrasonic bonding apparatus is configured to receive the flange and the cover of each container in the nip between the first bonding module and the second bonding module, wherein at least one of the first bonding module and the second bonding module vibrates at an ultrasonic frequency and delivers ultrasonic energy to at least one of the cover and the flange to seal the container, and wherein the nip has a nip thickness less than 0.03 in.; and a frame configured to prevent displacement of the second bonding module and the first bonding module during ultrasonic bonding of the flange and the cover.

2. The system of claim 1, wherein the ultrasonic bonding apparatus is a first ultrasonic bonding apparatus, the system further comprising a second ultrasonic bonding apparatus comprising:

a third bonding module; and a fourth bonding module positionable in close proximity to the third bonding module to define a nip therebetween, wherein the ultrasonic bonding apparatus is configured to receive the flange and the cover of each container in the nip between the third bonding module and the fourth bonding module, wherein at least one of the third bonding module and the fourth bonding module vibrates at an ultrasonic frequency and delivers ultrasonic energy to at least one of the cover and the flange to seal the container.

3. The system of claim 2, wherein the container includes a pair of longitudinal sides, the first and second bonding modules configured to form a first ultrasonic bond along one of the longitudinal sides and the third and fourth bonding modules configured to form a second ultrasonic bond along the other of the longitudinal sides.

4. The system of claim 3 further comprising a third ultrasonic bonding apparatus comprising:

a fifth bonding module; and a sixth bonding module positionable in close proximity to the fifth bonding module to define a nip therebetween, wherein the third ultrasonic bonding apparatus is configured to receive the flange and the cover of each container in the nip between the fifth bonding module and the sixth bonding module, wherein at least one of the fifth bonding module and the sixth bonding module vibrates at an ultrasonic frequency and delivers ultrasonic energy to at least one of the cover and the flange to seal the container.

5. The system of claim 4, further comprising a fourth ultrasonic bonding apparatus comprising:

a seventh bonding module; and an eighth bonding module positionable in close proximity to the seventh bonding module to define a nip therebetween, wherein the fourth ultrasonic bonding apparatus is configured to receive the flange and the cover of each container in the nip between the seventh bonding module and the eighth bonding module, wherein at least one of the seventh bonding module and the eighth bonding module vibrates at an ultrasonic frequency and delivers ultrasonic energy to at least one of the cover and the flange to seal the container.

6. The system of claim 5, wherein the container includes a pair of transverse sides extending between the longitudinal sides, the fifth and sixth bonding modules configured to form a third ultrasonic bond along one of the transverse sides and the seventh and eighth bonding modules configured to form a fourth ultrasonic bond along the other of the transverse sides.

7. The system of claim 6, wherein the first and third ultrasonic bonds overlap each other, and wherein the second and fourth ultrasonic bonds overlap each other.

8. The system of claim 1, wherein the system is configured to seal the container without the use of microwaves.

9. A method for packaging a food product in a container, said method comprising:

moving a tray in a machine direction, the tray including at least one wall defining a cavity and a flange extending from an edge of the wall, the flange having a single layer first area with a first thickness and a second area comprised of at least two layers with a second thickness, the second thickness being at least twice as thick as the first thickness;

depositing the food product into the cavity;

positioning a cover relative to the tray, wherein the cover is positioned to overlap the flange of the tray, the cover and the tray forming the container;

positioning a first bonding module including a disc-like rotary horn in close proximity to a second bonding module including a disc-like rotary anvil, wherein the disc-like rotary anvil has an annular face that is continuous about a circumference of the disc-like rotary anvil, and wherein at least one of the first bonding module and the second bonding module vibrates at an ultrasonic frequency;

positioning the flange and the cover in a nip defined by the first bonding module and the second bonding module; and delivering ultrasonic energy to at least one of the cover and the flange at the nip to form an ultrasonic bond on the container, the ultrasonic bond extending continuously in the machine direction along the entirety of the cover and the flange, wherein a frame is configured to prevent displacement of the second bonding module and the first bonding module during ultrasonic bonding of the flange and the cover.

10. The method of claim 9, wherein the container includes a pair of longitudinal sides, and wherein delivering ultrasonic energy comprises forming a first ultrasonic bond along one of the longitudinal sides and forming a second ultrasonic bond along the other of the longitudinal sides.

11. The method of claim 10, wherein the container includes a pair of transverse sides extending between the longitudinal sides, the method further comprising forming a third ultrasonic bond along one of the transverse sides and forming a fourth ultrasonic bond along the other of the longitudinal sides.

12. The method of claim 11, wherein the third ultrasonic bond is formed to overlap the first ultrasonic bond and the fourth ultrasonic bond is formed to overlap the second ultrasonic bond.

13. The method of claim 9, wherein the container is sealed without the use of microwaves.

14. The method of claim 9, wherein the nip has a thickness less than 0.03 in.

* * * * *